US011635267B1

(12) United States Patent
Rosenblum et al.

(10) Patent No.: US 11,635,267 B1
(45) Date of Patent: Apr. 25, 2023

(54) SPEED LOADER FOR FIREARMS MAGAZINE

(71) Applicants: Neal B. Rosenblum, Hollywood, FL (US); Mark Presser, Los Angeles, CA (US)

(72) Inventors: Neal B. Rosenblum, Hollywood, FL (US); Mark Presser, Los Angeles, CA (US)

( * ) Notice: Subject to any disclaimer, the term of this patent is extended or adjusted under 35 U.S.C. 154(b) by 0 days.

(21) Appl. No.: 17/671,595

(22) Filed: Feb. 15, 2022

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/82; F41A 9/66; F41A 9/67
See application file for complete search history.

(56) References Cited

U.S. PATENT DOCUMENTS

| | | | | |
|---|---|---|---|---|
| 10,132,582 | B1 * | 11/2018 | Zhou | F41A 9/83 |
| 10,175,017 | B2 * | 1/2019 | Cottrell | F41A 9/83 |
| 2004/0020096 | A1 * | 2/2004 | Tal | F41A 9/83 42/87 |
| 2019/0226780 | A1 * | 7/2019 | Slevin | F41A 9/83 |

* cited by examiner

*Primary Examiner* — J. Woodrow Eldred
(74) *Attorney, Agent, or Firm* — One LLP

(57) ABSTRACT

An apparatus for loading cartridges into a firearms magazine includes a loader body comprising a retainer configured for holding a firearms magazine, and cooperating spring-loaded plungers coupled thereto. A first spring-loaded plunger coupled to the loader body is oriented for pushing one or more cartridges into the firearms magazine so as to depress a magazine spring thereof. A second plunger coupled to the loader body is oriented for inserting cartridges into the firearms magazine without further depressing the magazine spring while the first spring-loaded plunger is depressing the magazine spring. A mechanism automatically resets the first spring-loaded plunger after the second plunger completes insertion of each cartridge into the magazine. All of the foregoing moving parts may be manually or motor driven and fed with cartridges via a hopper.

21 Claims, 34 Drawing Sheets

SECTION A-A

SECTION B-B
ROTATED 90° CW FOR CLARITY

SPEED LOADER FOR FIREARMS MAGAZINE

PRIORITY CLAIM

The present application is a continuation of U.S. patent application Ser. No. 16/724,162 filed Dec. 20, 2019, now U.S. Pat. No. 11,248,865, which is a continuation of International (PCT) patent application Serial No. PCT/US18/39159 filed Jun. 22, 2018, which claims priority to U.S. provisional patent application Ser. No. 62/523,711 filed Jun. 22, 2017, which applications are incorporated herein in their entireties by reference.

FIELD

The present application relates to apparatus and methods for aiding firearm users in the loading of magazines for holding ammunition cartridges.

BACKGROUND

Certain firearms, for example many semi-automatic pistols and assault rifles, are designed for use with multi-cartridge magazines wherein the cartridges are axially loaded in a horizontal direction into the magazine. Cartridges are loaded sequentially such that the last cartridge loaded into the magazine is the next one loaded into the firing chamber. Throughout this document, the term "cartridge(s)" and/or "round(s)" will be used interchangeably to refer to an assembly of a casing, bullet, gunpowder, and primer as commonly used in modern firearms.

Traditional magazines for firearms consist of a spring-loaded follower enclosed inside of a metal body, the magazine. The follower may be configured as a platform that moves upward under force of a spring. The spring can be compressed during loading of cartridges the follower is pushed down. The spring, or coil spring, rests on the inside bottom, or base, surface of the magazine and provides an upward force on the follower, or cartridge platform. As cartridges are loaded into the magazine, the follower is pushed in a downward direction against the resisting force, or reaction force, of the spring. The force required to insert each subsequent cartridge into the magazine increases with the amount of deflection of the spring. Typically, there is a linear relationship between the reaction force of a coil spring and the amount of deflection of that coil spring. Accordingly, the last cartridge inserted into the magazine requires substantially more downward vertical force than the downward vertical force required to insert the first cartridge.

There are many types of magazines commercially available in the marketplace. Magazines are unique to each firearm as they have various spring constants, designs, ergonomic features, mechanical attributes, locking mechanisms, and/or other features. Some magazines allow for a single column of cartridges to be loaded whereby one is directly above and slightly in front of the other. These are called single stack magazines. These are designed to fit into pistols that are sometimes used for concealed carry use, where and under the circumstances it is legal, and/or where the user wants to minimize the overall size of the firearm yet have multiple rounds in the fully loaded magazine. Other magazines provide for more cartridge capacity at the expense of the size; width or length, by staggering the cartridges in the magazine in a left-to-right fashion. This results in a wider grip for the firearm, but with a substantial increase in the number of rounds in a fully loaded magazine. These are called double stack magazines.

Both types of magazines require the user to push down on the spring-loaded follower/platform in order to deflect the spring enough so the user can insert the first cartridge into the magazine. Once the first cartridge has been inserted (loaded), rather than pushing directly on the follower, the user must push down on the previous cartridge using fingers, which in turn, transfers the load to each cartridge below it and then to the follower.

Users typically set the outside bottom surface of a magazine down on a table or other stable surface prior to pushing down on the follower/cartridges. The user typically uses his/her thumb to push down on the follower/cartridges. This results in distress to the skin in the form of bruised or bleeding skin, sore muscles, callouses, numbness in the finger tips, broken and/or deformed fingernails, hand fatigue, difficultly especially for those users with arthritis or neuropathy, and many other undesirable side effects. It also takes a relatively long time to place each individual round into the magazine, especially as the user may have to pause in between cartridges to rest his/her hand due to the physical pain and/or fatigue involved with loading a magazine. In the case where the user is loading multiple magazines, the pain and distress to the user's fingers can be quite overwhelming.

Several prior art devices aid firearm users in loading magazines. Some of these devices are very simple, using a plastic sleeve or flexible material body with an integrated vertical finger protrusion. As the sleeve is placed over the magazine, the user must apply a vertical force in the downward direction to the sleeve. As the sleeve slides in a downward direction around the body of the magazine, the vertical finger protrusion pushes down on the follower or subsequently inserted cartridges (follower/cartridges), creating a void between the top of the follower/cartridge and the top cartridge-retaining features of the magazine. At first, the user can then easily partially insert a cartridge into the magazine until the rear surface of the cartridge contacts the vertical finger protrusion. The user then releases the downward force on the sleeve and must use their fingers to apply an axial force in the horizontal direction to push the cartridge the remaining distance into the magazine so that the rear surface of the cartridge contacts the rear inside surface of the magazine. This also results in pain and distress to the user's fingers.

Other prior art devices use a spring-loaded mechanism to further aid in inserting cartridges into the magazine. These devices allow the user to insert the cartridges into the magazine without having to push them in. The user can gently insert the cartridges into the magazine one by one with no additional horizontal axial load. An example is shown in U.S. Pat. No. 7,503,138. However, the user must use their body weight to press the cartridges into the magazine, and unless the user is careful they may deform the magazine casing. Not only can this result in damage to the magazine, it can also cause damage to the firearm when the magazine is used.

Other devices use the mechanical advantage of a lever to push each individual cartridge into the magazine by using a complex system of adjustments and numerous parts. Each cartridge is placed into a receptacle where is it pushed into the magazine by the user with minimal direct interaction with the magazine itself. Due to details of construction, some users may find it difficult to adjust the loader for different magazines, and to press the last cartridges of the magazine into place.

It would be desirable, therefore, to develop new methods and apparatus for loading cartridges into firearm magazines, that overcome these and other limitations of the prior art.

SUMMARY

This summary and the following detailed description should be interpreted as complementary parts of an integrated disclosure, which parts may include redundant subject matter and/or supplemental subject matter. An omission in either section does not indicate priority or relative importance of any element described in the integrated application. Differences between the sections may include supplemental disclosures of alternative embodiments, additional details, or alternative descriptions of identical embodiments using different terminology, as should be apparent from the respective disclosures.

The present disclosure describes two distinct embodiments for loading magazines, one that operates manually and another that is powered by a motor. Both may be referred to herein as a Speed Loader for Firearm Magazines and abbreviated as SLFM. Both aid firearm users in loading magazines for semi-automatic pistols or other firearms using similar cartridges, allowing the user to place multiple cartridges into a hopper with no distress to their fingertips. The apparatus then allows the user to very safely and rapidly insert multiple cartridges into the magazine with a combination of vertical and horizontal reciprocating plunger movements without distress to the user's fingertips and/or hands.

In manually-powered embodiments, the speed loader may be shaped like a pistol. Instead of shooting bullets that are dispensed from a magazine as you would from a pistol, an opposite method is used to load the magazine. The apparatus thereby makes intuitively obvious to any user, beginning, intermediate, or advanced how the apparatus is held and functions.

The apparatus uses one spring-loaded vertical plunger to push the follower/cartridge in a downward direction for easy and rapid loading of cartridges into firearm magazines. The top surface of the vertical plunger has a large comfortable contoured surface which relieves the user of the need to exert a high concentrated force experienced by pushing directly on the follower/cartridge with one's fingertips. The large surface area distributes the force and reduces the pressure applied to the user's finger, typically their thumb. Once the follower/cartridge has been displaced by the downward movement of the vertical plunger by approximately one cartridge diameter, the vertical plunger locks in the down position and remains locked in the down position until a cartridge is loaded in the magazine and the subsequent cartridge bumps the plunger and releases it so that it pops back up and out of the way, allowing the next cartridge to be loaded individually or from the hopper. Cartridges may be fed to a loading chamber by gravity from a hopper in advance of use of the horizontal plunger, eliminating the need for the user to manually insert cartridges one at a time into the apparatus.

Furthermore, the apparatus uses a second plunger that moves in a horizontal direction. As the user pushes on the horizontal plunger, the concave tip of the horizontal plunger captures the tip of the cartridge and slides the cartridge into the magazine. Once the rear surface of the cartridge "bumps" into the vertical plunger, the vertical plunger pops up and out of the way so that the cartridge can be completely pushed into the magazine until the plunger "bottoms out" on the barrel of the loader body. The second plunger is coupled to a return mechanism. In manual embodiments, the return mechanism may comprise a return spring. In motorized embodiments, the return mechanism may comprise a slider-crank mechanism driven by a motor.

By repeating this motion several times, the magazine can be rapidly filled with minimal handling of the cartridges and no distress to the users fingers or hands.

The speed loader includes two key safety features. The first safety feature prevents the primer of the next cartridge being inserted from being forced into the tip of the previously inserted cartridge in the event that the user forgets to push down on the vertical plunger or in the event that the vertical plunger fails to lock in the down position prior to pushing the horizontal plunger in a rearward direction toward the magazine, which may cause unintended discharge. This first safety feature uses an independently spring-loaded flat wall that blocks the entrance to the magazine while the vertical plunger is in the up position, and it prevents any additional cartridges from being inserted into the magazine and prevents the primer on the cartridge being inserted from being forced into the tip of the previously inserted cartridge. The rear surface of the incoming cartridge can only be forced up against the flat wall of the SLFM when the horizontal plunger is pushed in a rearward direction with no chance of the primer of the incoming cartridge striking the tip of the previously loaded cartridge.

Only after the vertical plunger is pushed and locked in the down position can the incoming cartridge pass through a hole in the wall that is located approximately one cartridge diameter above the flat portion of the wall. Once the rear surface of the incoming cartridge bumps the rear plunger and pops it up, the wall will stay in the down (closed) position until the incoming cartridge fully passes through the hole and the spring-loaded horizontal plunger retracts to its resting position, at which time the return spring for the wall will push the wall back up to its resting position and once again block the transit of an incoming cartridge into the magazine until the rear plunger is once again locked in the down position.

In alternative embodiments, additional safety features might further limit any horizontal plunger travel whatsoever until the vertical plunger is locked in a down (open for loading) state. This might be implemented using a ball and spindle similar to that found on any commercially available off-the-shelf ball lock pin. Downward movement of the vertical plunger would move a shaft forward thus relieving pressure on the ball that locks the horizontal plunger in place and therefore allowing the horizontal plunger to travel in a rearward direction.

If the magazine is fully loaded and there are additional cartridges in the cartridge hopper, the rear plunger cannot be pushed down to allow transit of any additional cartridges into the magazine.

A second safety feature uses the barrel of the loader body and the horizontal plunger flange as the limiting features for the horizontal movement of the horizontal plunger and therefore the cartridge. This prevents the rear surface of the cartridge being loaded from striking the inside front surface of the previously loaded cartridge as the new cartridge is pushed into the magazine.

Even without these safety features, cartridges are extremely stable and can be dropped and abused and will not fire until a highly concentrated force is applied directly to the primer by the firing pin of the firearm. The chances of accidental discharge are extremely low, and with the addition of these two safety features, the chances of accidental discharge while loading a magazine with this apparatus are virtually zero.

Surprisingly, the combination of certain elements of the manual loader described above are adaptable for use in a motorized magazine loader. The motorized loader includes the advantages noted above, with the added advantages of greater speed, stability and less exertion by the user. Structure and operation of the machine loader are described in the detailed description that follows.

To the accomplishment of the foregoing and related ends, one or more examples comprise the features hereinafter fully described and particularly pointed out in the claims. The following description and the annexed drawings set forth in detail certain illustrative aspects and are indicative of but a few of the various ways in which the principles of the examples may be employed. Other advantages and novel features will become apparent from the following detailed description when considered in conjunction with the drawings and the disclosed examples, which encompass all such aspects and their equivalents.

BRIEF DESCRIPTION OF THE DRAWINGS

The features, nature, and advantages of the present disclosure will become more apparent from the detailed description set forth below when taken in conjunction with the drawings in which like reference characters identify like elements correspondingly throughout the specification and drawings.

DETAILED DESCRIPTION

Various aspects are now described with reference to the drawings. In the following description, for purposes of explanation, numerous specific details are set forth in order to provide a thorough understanding of one or more aspects. It may be evident, however, that the various aspects may be practiced without these specific details. In other instances, well-known structures and apparatus are shown in block diagram form in order to facilitate describing these aspects.

Figure 1:
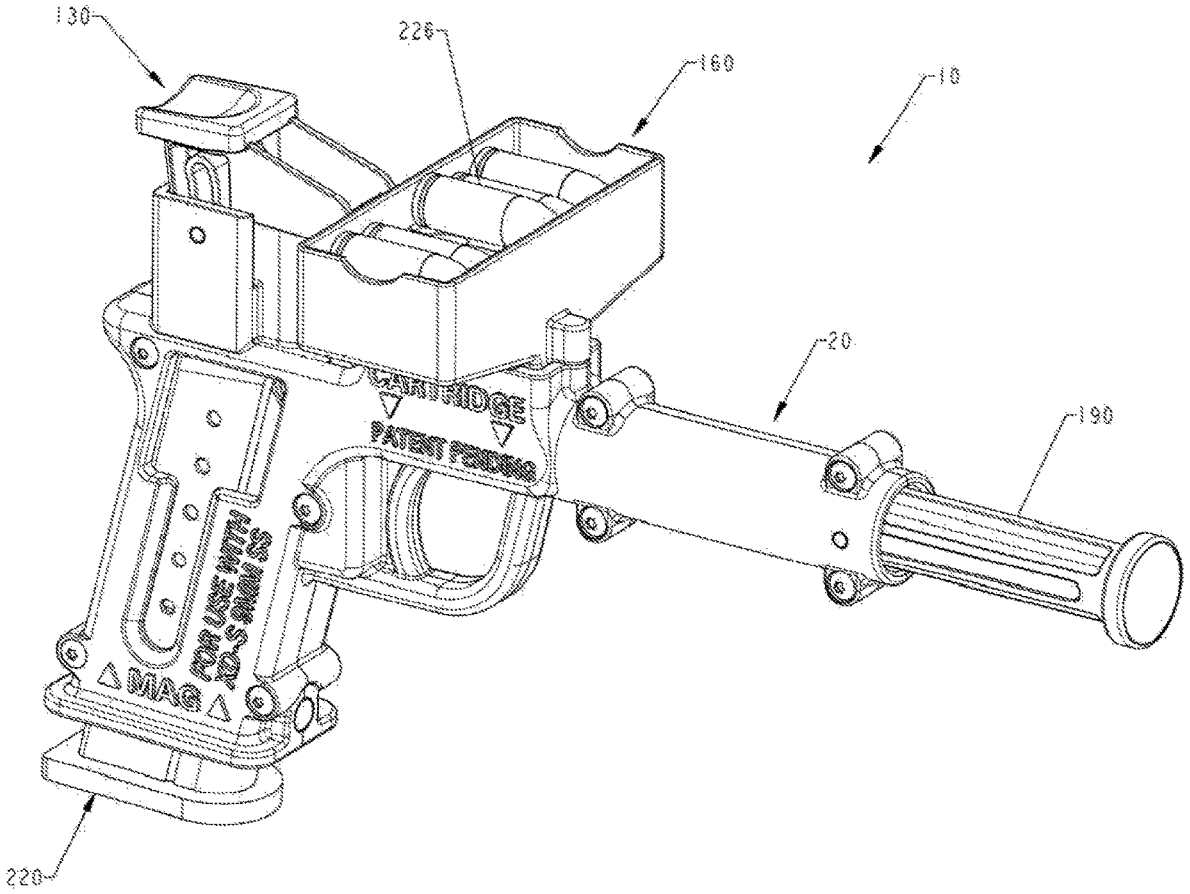
FIG. 1 is a frontal perspective view of the apparatus showing the present invention, with example markings showing a particular manufacturer's magazine, but the apparatus can be adapted to fit a variety of manufacturer's magazines.
Figure 18:
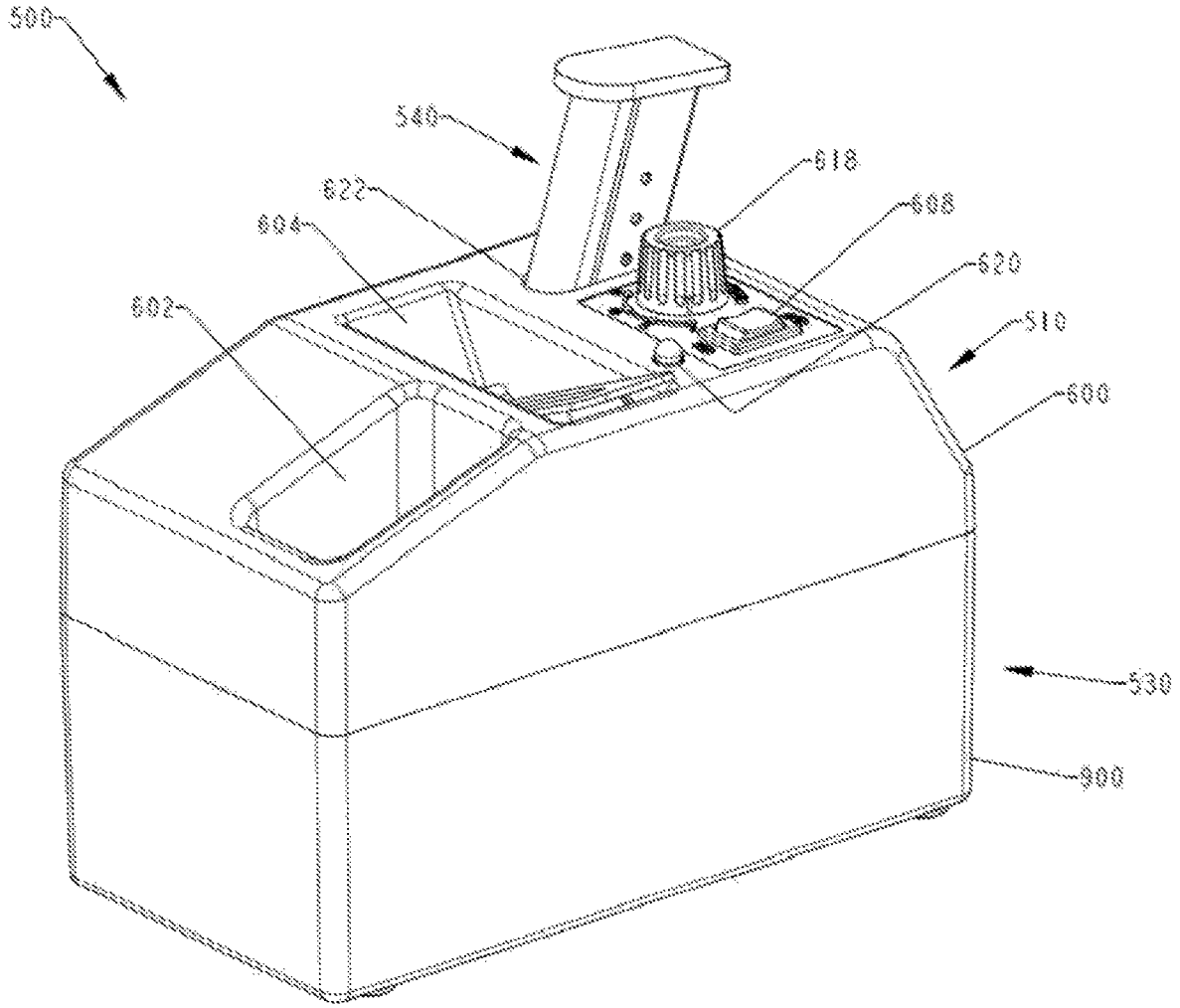
FIG. 18 is a left perspective view of a motorized SLFM.
Figure 19:
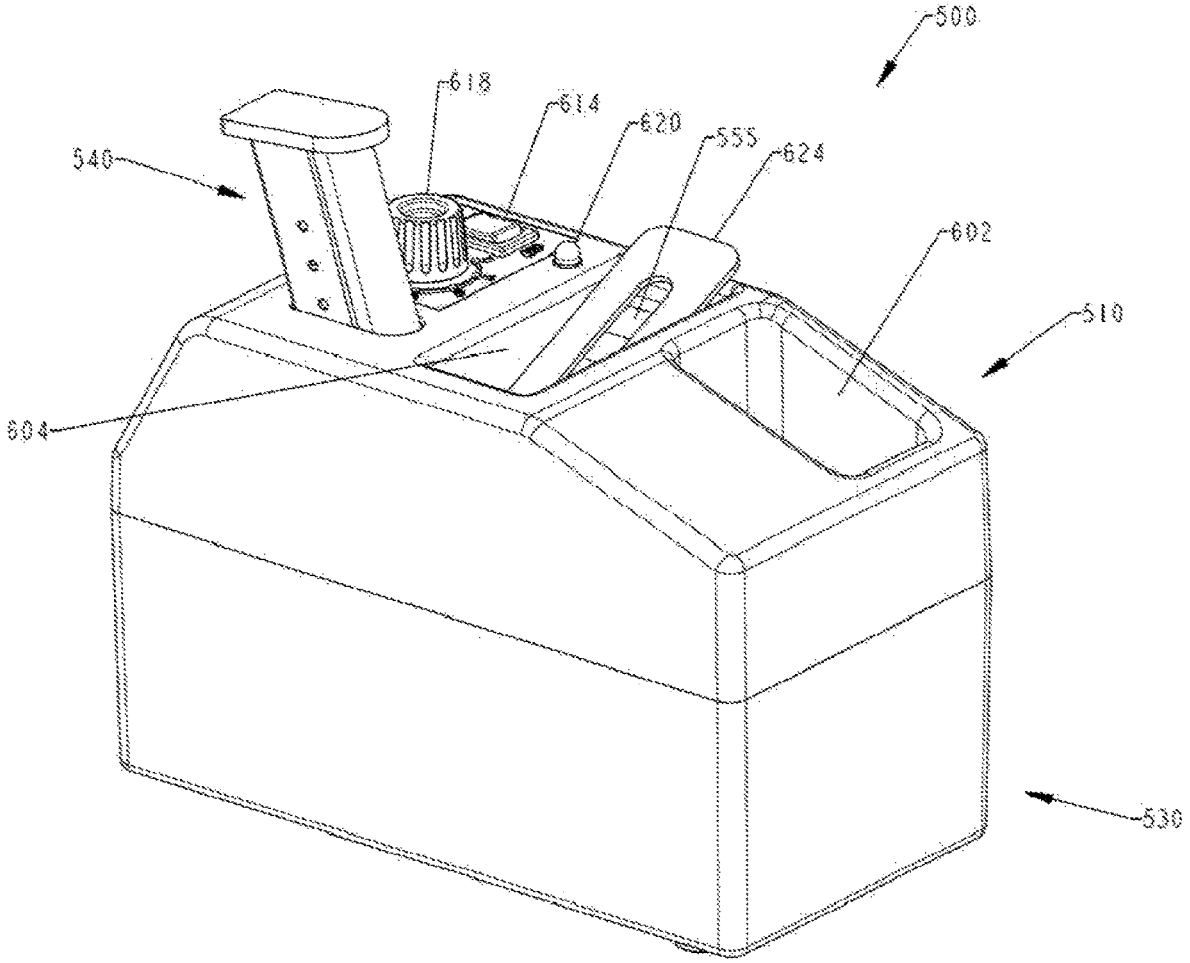
FIG. 19 is a right perspective view of the motorized SLFM.

For purposes of the present description, the terms "upper," "lower," "left," "rear," "right," "front," "vertical," "horizontal," and derivatives thereof, shall relate to the apparatus as oriented in FIGS. 1 and 18. It is also to be understood that the specific apparatus and processes illustrated in the attached drawings, and described in the following specification, exemplify the subject matter without limiting the inventive aspects defined in the appended claims. For example, specific dimensions and other physical characteristics relating to the embodiments disclosed herein are not to be considered as limiting, unless the claims expressly state otherwise. Similarly, the claims are not limited by any expressed or implied theory of operation presented herein, if any.

Referring now to the drawings wherein like elements are represented by like numerals throughout, there is shown in FIG. 1, a frontal perspective view of a manual SLFM 10. Various components of the apparatus are shown with the vertical plunger 130, horizontal plunger 190, cartridge hopper 160, and magazine 220 all assembled to the loader body 20. It can be readily understood how the apparatus has the overall form factor of a small pistol and how the user would likely grip the apparatus. As used herein, a "plunger" is a sliding mechanism contained by a barrel or channel, lacking any feature for exerting force on a cartridge by pivoting or rotating. It should be appreciated that "vertical" and "horizontal" are terms of convenience only in relation to the Figures, and may be replaced by "first" and "second," respectively, without misdescription. The vertical plunger may include a pin-in-slot 48, 134 or equivalent mechanism and may be constrained by a guide that allows just enough rotation for locking and unlocking the vertical plunger as described in more detail below. The first ("vertical") plunger 130 is coupled to the loader body 20 and oriented for pushing one or more cartridges into the firearms magazine 220 so as to depress a magazine spring 224 thereof, a direction referred to herein as "down" for convenience only. The second ("horizontal") plunger 190 is coupled to the loader body 20 and configured for inserting cartridges into the firearms magazine 220 without further depressing the magazine spring 224 while the first spring-loaded plunger 130 is depressing the magazine spring, a direction referred to herein as "horizontal" for convenience only. As shown in FIGS. 1-7, the cartridges are aligned horizontally by the follower 222 and sidewalls of the magazine 220, so the second plunger inserts cartridges in a direction parallel to the orientation of the follower and to previously inserted cartridges. The second plunger 190 does not pivot or rotate.

Figure 2:
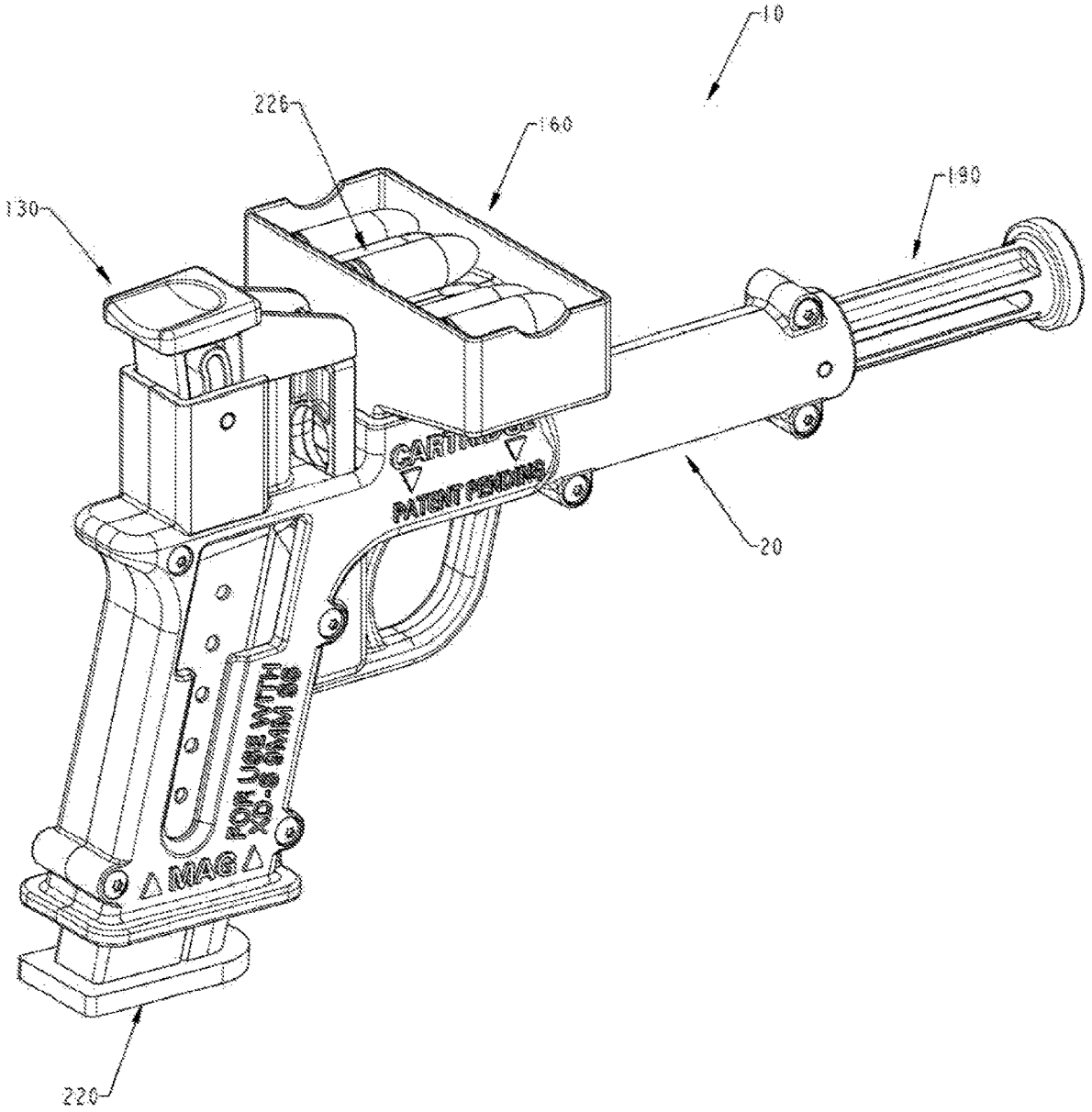
FIG. 2 is a rear perspective view of the apparatus shown in FIG. 1.

As shown in FIG. 2, a rear perspective view of the apparatus 10 is illustrated. This view supplements the front view of FIG. 1 and makes more apparent how the user would wrap his/her hand around the SLFM 10.

Figure 3:
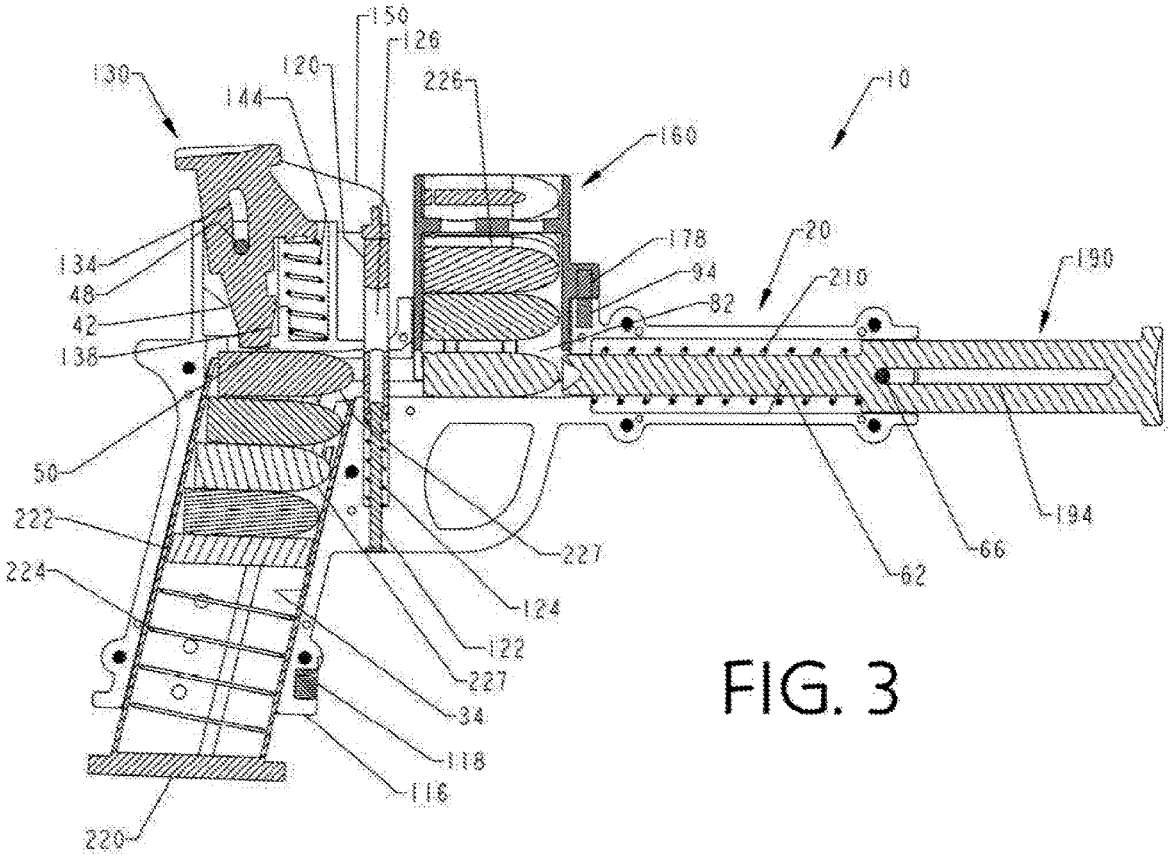
FIG. 3 is a cross section view of the apparatus shown in its resting state.

In FIG. 3, a cross sectional view of the SLFM 10 is shown in its "at-rest" state. The vertical plunger 130 is located in the vertical plunger cavity 42 and is shown in its retracted, or "up", state. The vertical plunger 130 is being pushed in an upward direction by return spring 144 and is limited in vertical travel by a retention pin 48 in pin guide slot 134. A sliding or otherwise movable safety wall 120 is in its "up" state being urged by the safety wall return spring 124 in an upward direction against the cantilever safety wall pusher 150. The safety wall guide pin 122 prevents the safety wall return spring 124 from buckling when compressed and guides the safety wall return spring 124 to exert a vertical component of force on the safety wall 120. With the safety wall 120 in its "up" position, the newly loaded cartridge 227 is safely separated from the previously loaded cartridge 226 by the safety wall 120. The safety wall is interposed between the cavity 34 (retainer for magazine) and the horizontal plunger 190.

Similarly, the horizontal plunger 190 is inserted into the barrel cavity 62 and shown in its retracted state. The horizontal plunger 190 is being pushed in a forward horizontal direction by return spring 210 and limited in travel by guide pin 66 in pin guide slot 194. In FIG. 3, the cartridge hopper 160 is shown seated in the cartridge entrance cavity 82 and held in place by mating magnets 94,178 on the loader body 20 and cartridge hopper 160, respectively. A magazine 220 is shown inserted in the magazine cavity 34 of the loader body 20. The cavity 34 is an example of a retainer for holding a magazine in position relative to the vertical and horizontal plungers 130, 190. One of ordinary skill may design other useful retainers. Several cartridges 229 are shown in both the cartridge hopper 160 and magazine 220.

Figure 4:
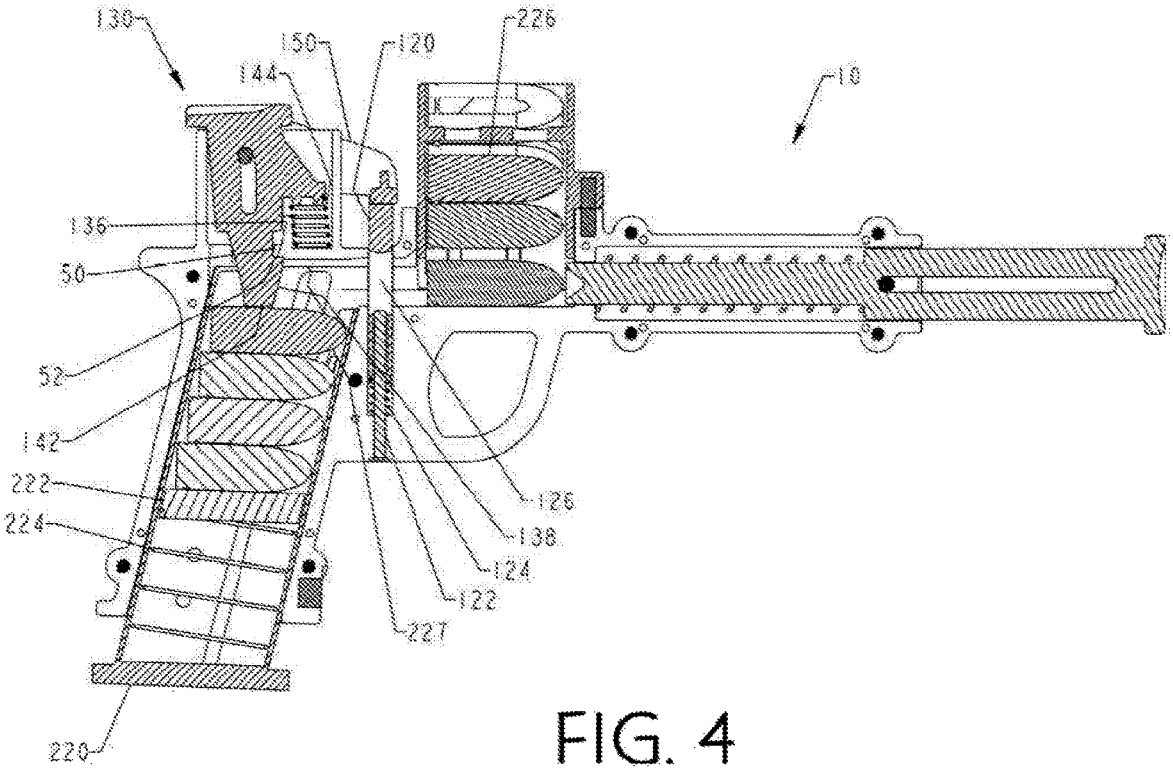
FIG. 4 is a cross section view of the apparatus shown with the vertical plunger depressed and locked in a down state.

FIG. 4 shows a cross sectional view of the apparatus with the vertical plunger 130 pushed down to a locked state, or down position. In arriving at this locked state, the vertical plunger ramp 138 on vertical plunger 130 slides against the mating ramp 50 on the loader body 20. As the vertical plunger 130 continues to be pushed in a downward direction, the cartridge centering feature 142 on the end of the vertical plunger 130 begins to push either the follower 222 or the upper-most cartridge 226 in the magazine 220 in a downward direction against the force of the magazine spring 224. Once the plunger 130 has progressed far enough, the snap feature ledge 136 of the vertical plunger 130 engages the snap feature ledge 52 of the loader body 20, locking the plunger in a depressed position and creating a free space for entry of a cartridge in a direction approximately perpendicular to the motion vector of the first plunger 130. The return spring 144 for the vertical plunger 130 creates a moment (torque) on the vertical plunger 130 that causes the snap feature ledge 136 to rotate slightly forward and remain locked in the down position as it engages the snap feature ledge 52 of the loader body 20. As the vertical plunger 130 is pushed down and locked in the down state, the safety wall 120 is simultaneously pushed down by the safety wall cantilever pusher 150 and exposes the safety wall cartridge pass-thru hole 126 in the wall to the next cartridge 227. Thus, rearward horizontal translation of the next cartridge 227 will not make any contact with the previously cartridge 226, especially no primer-to-tip contact.

Figure 5:
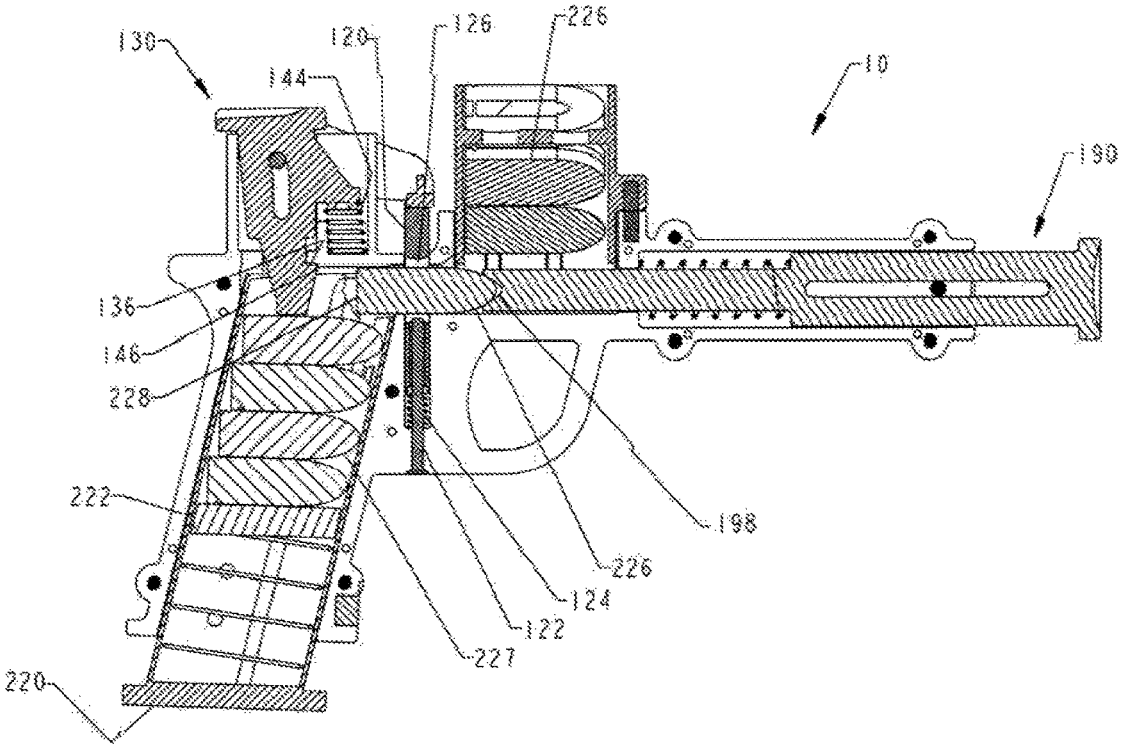
FIG. 5 is a cross section view of the apparatus showing the horizontal plunger pushed rearward contacting the cartridge, the cartridge displaced a short distance in a rearward direction through an opening in a safety wall.

In FIG. 5, a cross sectional view of the apparatus is shown with the vertical plunger 130 and safety wall 120 both in their down positions and the horizontal plunger 190 pushed slightly rearward. The concave tip 198 at the far end of the horizontal plunger 190 engages the end of the cartridge 226 that has fallen into the cartridge cavity 82. In doing so, the horizontal plunger 190 can center the rearward horizontal force along the axis of the incoming cartridge 226 to minimize contact between the cartridge 226 and the inside walls of the loader body 20 and the inside walls of the magazine 220. Any additional contact between the cartridge and these other components will create a frictional component of force that may make it more difficult to push the cartridges 226 into the magazine 220. The cartridge 226 is pushed partially through the safety block pass-thru hole 126 and partially into the magazine 220. The cartridge 226 is further pushed until the rear surface 228 of the cartridge 226 contacts the front face 146 of the vertical plunger snap feature ledge 136.

Figure 6:
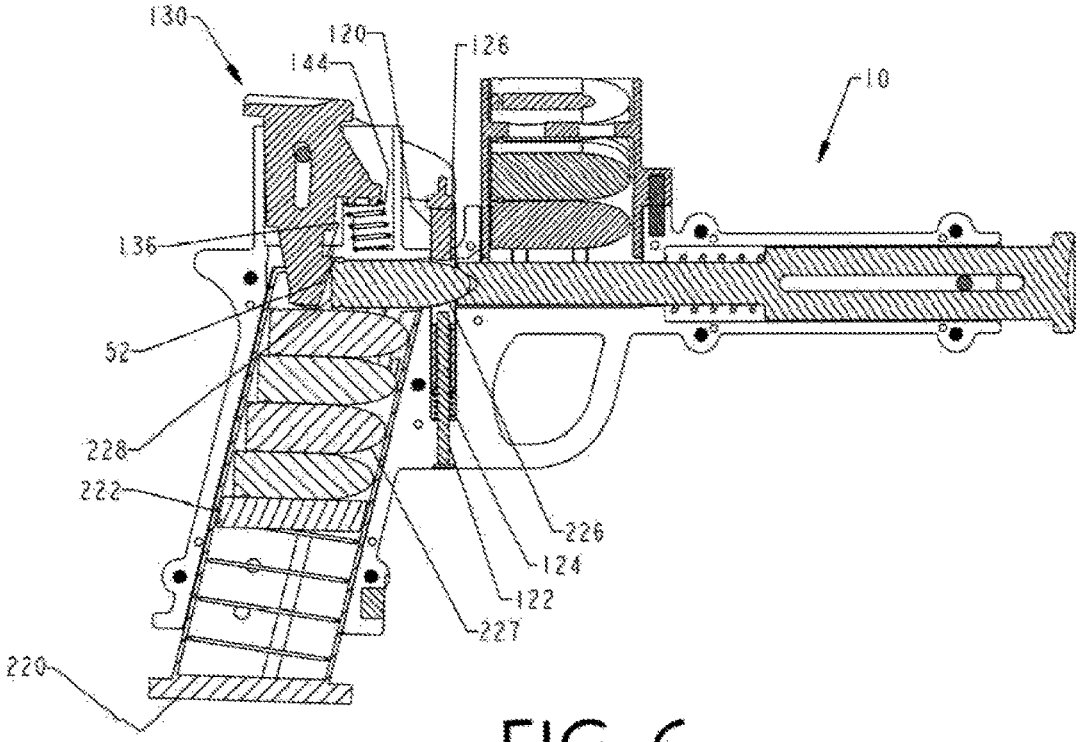
FIG. 6 is a cross section view of the apparatus shown with the vertical plunger snap feature bumped off of the snap ledge just prior to the vertical plunger rebounding.

In FIG. 6, a cross sectional view of the apparatus is shown with the rear surface 228 of incoming cartridge 226 bumping the vertical plunger snap ledge 136 off of the loader body snap ledge 52. As soon as this occurs, the vertical plunger return spring 144 causes the vertical plunger 130 to pop up almost instantaneously. Together, the return spring 144 and snap ledges 136, 52 make up a reset mechanism that automatically resets the first spring-loaded plunger 130 after the second plunger 190 completes insertion of each cartridge into the magazine, with a locking component supplied by the interlocking snap ledges 136, 52. Continued rearward horizontal force on the horizontal plunger 190 will complete the loading of an individual cartridge 226 as will be discussed below in connection with FIG. 7. The safety wall 120 remains in the down state as long as either the cartridge 226 or the plunger 190 are engaged in the safety wall pass-thru hole 126.

Figure 7:
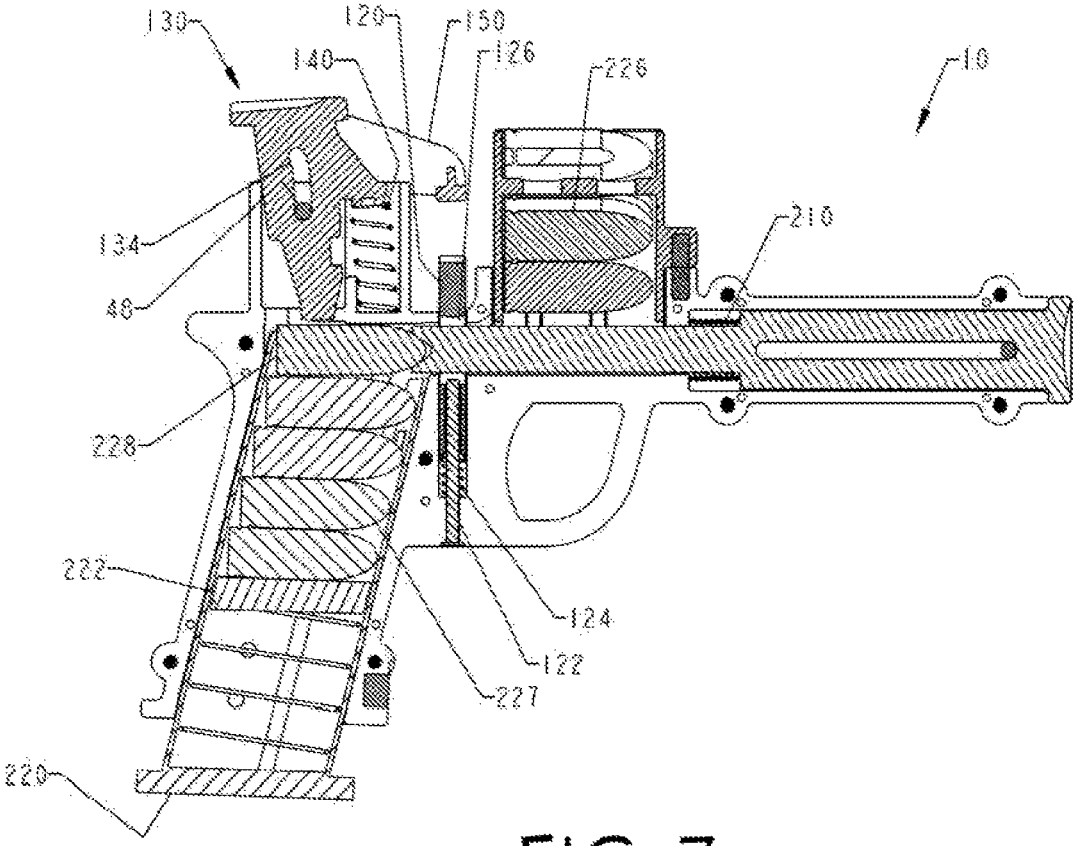
FIG. 7 is a cross section view of the apparatus shown with the vertical plunger rebounded to its resting state and the horizontal plunger pushed all the way back so the at the cartridge is fully inserted into the magazine. The plunger keeps the wall retained in the wall's down position until the plunger rebounds to its resting state.

In FIG. 7, a cross sectional view of the apparatus is shown with the horizontal plunger 190 pushed in a rearward direction until the flange 202 of the horizontal plunger 190 bottoms out on the front face of the barrel 60 of the loader body 20. Notice how the plunger 190 is still engaged in the safety wall pass-thru hole 126. At this moment, the user can release the rearward force on the horizontal plunger. The return spring 210 pushes the horizontal plunger 190 back to its "at-rest" state, the safety wall can "pop" back up to its resting state as it contacts the cantilever safety wall pusher 150, and the next cartridge 226 falls into the cartridge cavity 82 for the next iteration of this process. Once the magazine 220 is fully loaded with cartridges, the user will no longer be able to push the vertical plunger 130 down far enough to lock it in the down state. There can still be cartridges 226 in the cartridge hopper 160, and these can be easily poured back in the box from where they came.

Figure 8:
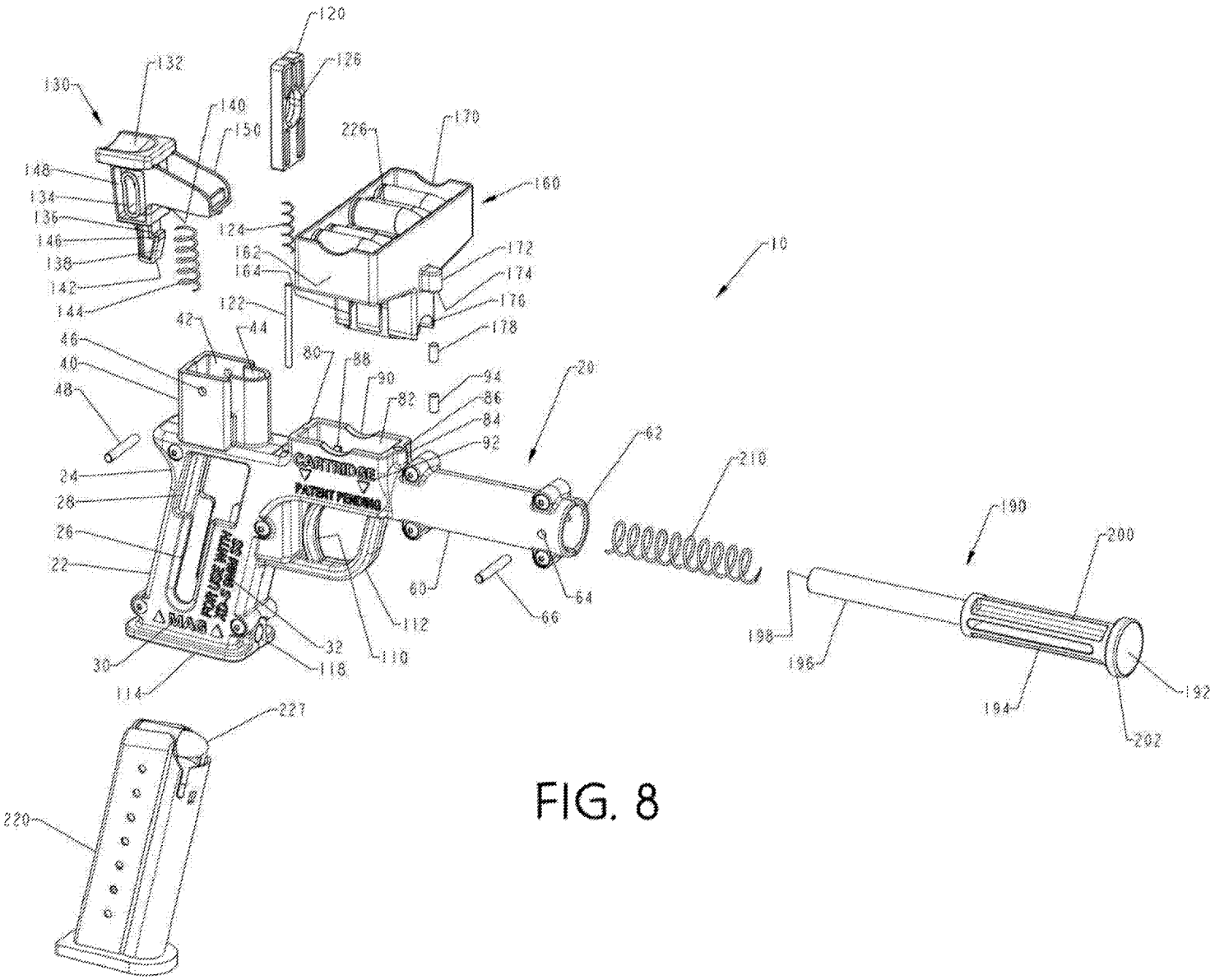
FIG. 8 is an exploded perspective view of the apparatus shown in FIG. 1.

In FIG. 8, an exploded view of the entire assembly 10 showing all of the components and various features within the components that enable this apparatus to properly function as a speed loader. Table 1 below lists the components with a brief description of each:

TABLE 1

| INDEX | DESCRIPTION |
|---|---|
| 10 | speed loader for firearms magazine (SLFM) assembly, 7-cartridge magazine without spacer |
| 15 | speed loader for firearms magazine (SLFM) assembly with magazine clamp, 9-cartridge magazine with spacer |
| 20 | loader body |
| 22 | handle |
| 24 | thenar grip area (thenar is the portion of hand between index finger and thumb) |
| 26 | cartridge capacity viewing window |
| 28 | cartridge entry viewing window |
| 30 | text indicating insertion direction for magazine |
| 32 | text indicating the appropriate magazine compatibility |
| 34 | magazine cavity |
| 40 | vertical plunger boss |
| 42 | vertical plunger cavity |
| 44 | spring cavity |
| 46 | retention pin hole |
| 48 | retention pin |
| 50 | ramp, loader body |
| 52 | snap feature ledge, loader body |
| 60 | horizontal plunger barrel |
| 62 | barrel cavity |
| 64 | retention pin hole |
| 66 | retention pin |
| 80 | cartridge boss |
| 82 | cartridge entrance cavity |

TABLE 1-continued

| INDEX | DESCRIPTION |
|---|---|
| 84 | magnet boss |
| 86 | magnet hole |
| 88 | cartridge/hopper guide rail |
| 90 | finger clearance cut |
| 92 | text indicating insertion direction for individual cartridges and/or cartridge hopper |
| 94 | magnet |
| 110 | faux trigger (fixed, or movable but disconnected from operative mechanisms) |
| 112 | faux trigger guard |
| 114 | flange |
| 116 | magnet boss |
| 118 | magnet |
| 120 | safety wall |
| 122 | safety wall guide pin |
| 124 | safety wall return spring |
| 126 | safety wall cartridge pass-thru hole/slot |
| 130 | sliding spring-loaded ("vertical") plunger |
| 132 | thumb grip/indentation |
| 134 | pin guide slot |
| 136 | snap feature ledge, vertical plunger |
| 138 | ramp, vertical plunger |
| 140 | spring post |
| 142 | cartridge centering feature |
| 144 | return spring for vertical plunger |
| 146 | front face of snap feature |
| 148 | material saver |
| 150 | cantilever safety wall pusher |
| 155 | cartridge hopper assembly |
| 160 | cartridge hopper |
| 162 | hard stop |
| 164 | guide rail clearance cut |
| 170 | finger clearance cut for cartridge insertion |
| 172 | magnet boss |
| 174 | magnet hole |
| 176 | cartridge clearance cut |
| 178 | magnet |
| 180 | hopper ceiling |
| 182 | hopper ceiling viewing holes |
| 184 | ramp |
| 186 | plunger clearance feature |
| 188 | cartridge-shaped thru hole |
| 190 | horizontal plunger |
| 192 | thumb grip/indentation |
| 194 | pin guide slot |
| 196 | plunger pilot cylinder |
| 198 | concave plunger tip |
| 200 | material saver |
| 202 | flange, horizontal plunger |
| 210 | return spring for horizontal plunger |
| 220 | magazine, 7 cartridge capacity |
| 222 | follower for transferring force of magazine spring to cartridges |
| 224 | magazine spring for ejecting cartridges |
| 226 | cartridge in hopper/loading chamber |
| 227 | cartridge loaded in magazine |
| 228 | rear surface of cartridge |
| 230 | magazine, 9 cartridge capacity |
| 232 | magazine spacer |
| 250 | magazine clamp assembly |
| 252 | clamp body |
| 254 | knob boss |
| 256 | threaded insert |
| 258 | clamp pad |
| 260 | clamp pad recess |
| 262 | clamp knob |
| 264 | finger grip features |
| 266 | magnet boss |
| 268 | magnet |
| 270 | threaded rod |
| 272 | viewing window |
| 274 | loader body flange slot |

Figure 9:
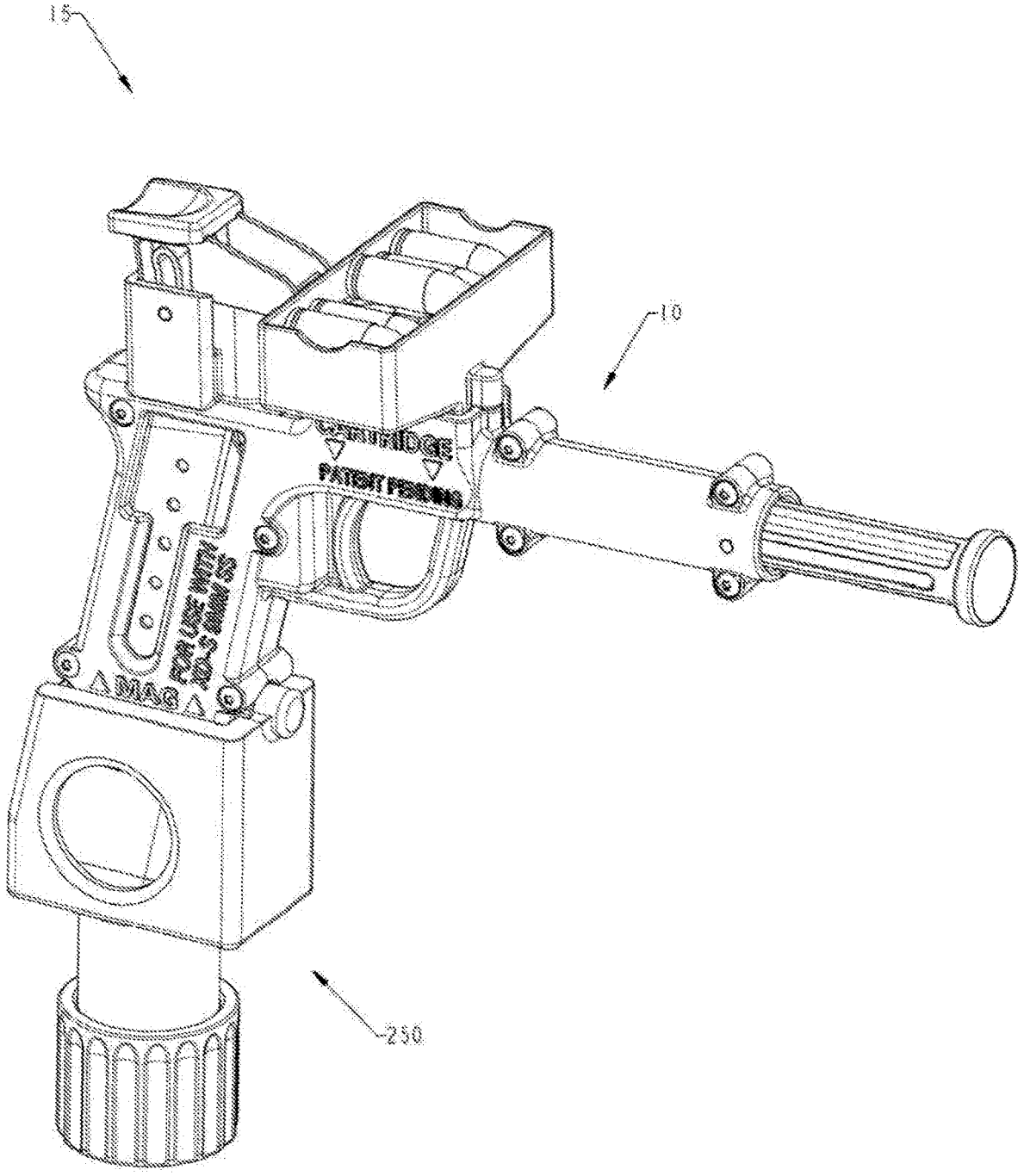
FIG. 9 is a frontal perspective view of the loader assembly with an additional magazine clamp assembly.

FIG. 9 shows another embodiment 15 in a frontal perspective view, showing the assembly of the loader assembly 10 with the magazine clamp assembly 250. The speed loader 10 can be used with or without the magazine clamp assembly 250, depending on user preference and ease of use for each individual user based upon physical strength and coordination.

Figure 10:
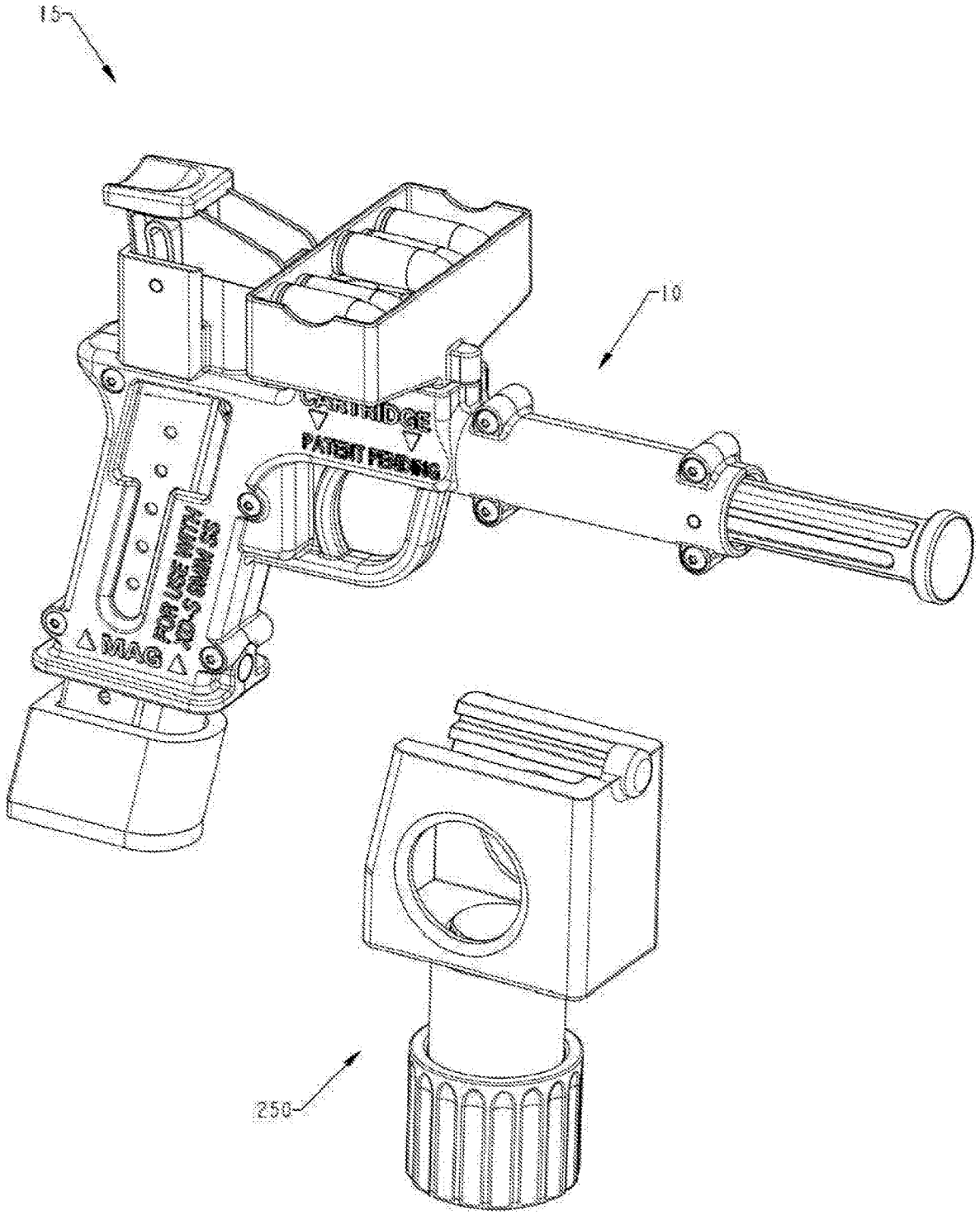
FIG. 10 is a frontal exploded view showing the magazine clamp assembly removed from the loader assembly.

FIG. 10 shows an exploded view of the apparatus shown in FIG. 9 with the magazine clamp assembly 250 separated from the loader assembly 10.

Figure 11:
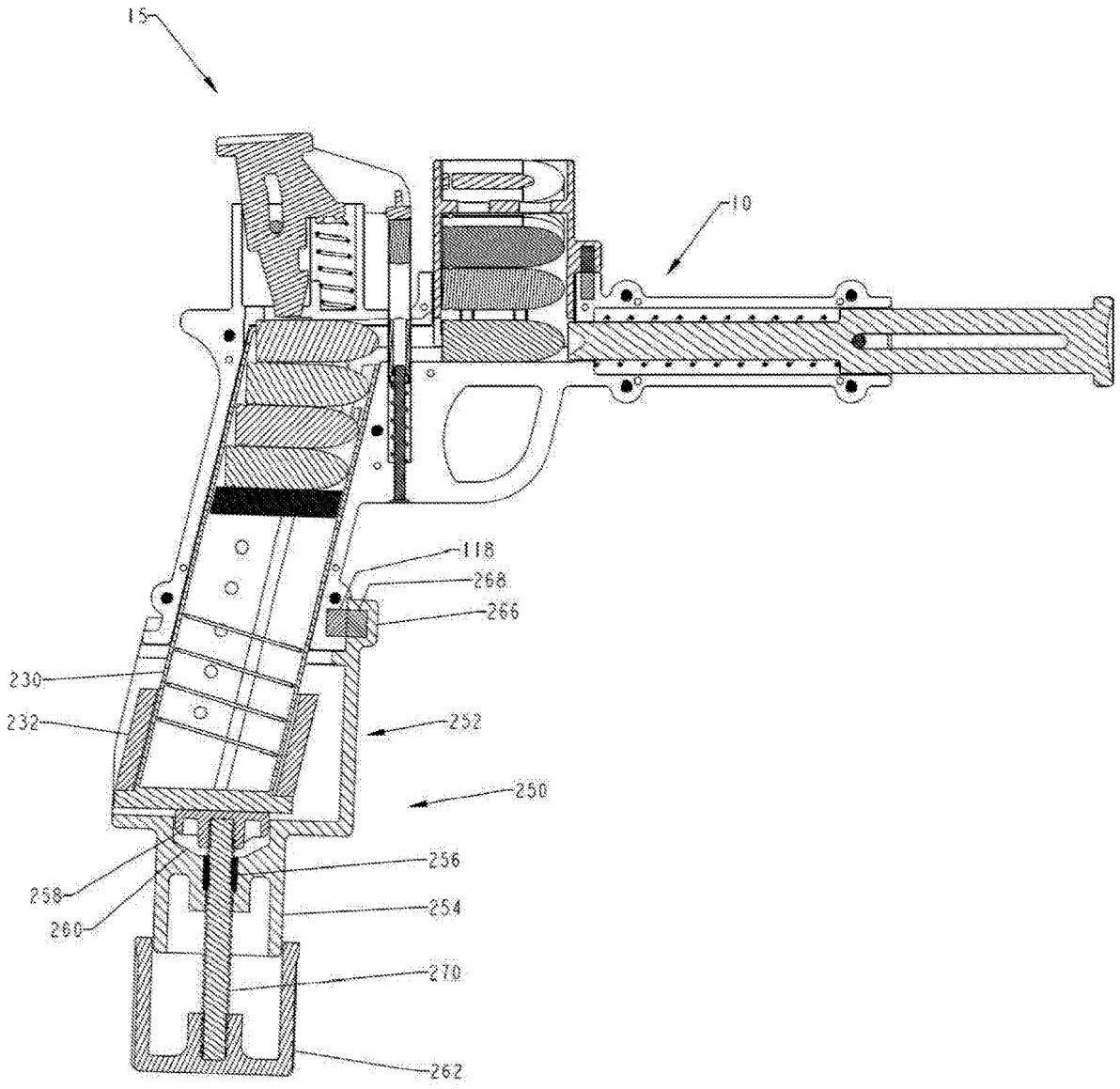
FIG. 11 is a cross section view showing the magazine clamp assembly holding a magazine clamped in the loader assembly.

FIG. 11 shows a cross section view of the magazine clamp assembly 250 attached to the loader assembly 10. Magnets 118, 268 on the loader body 20 and clamp body 252, respectively, hold the magazine clamp assembly 250 attached to the loader assembly 10. The magazine clamp assembly 250 can be easily removed from loader assembly with a light forward force on the magazine clamp assembly 250 so that the force exceeds the attraction force between the magnets 118, 268.

Figure 12:
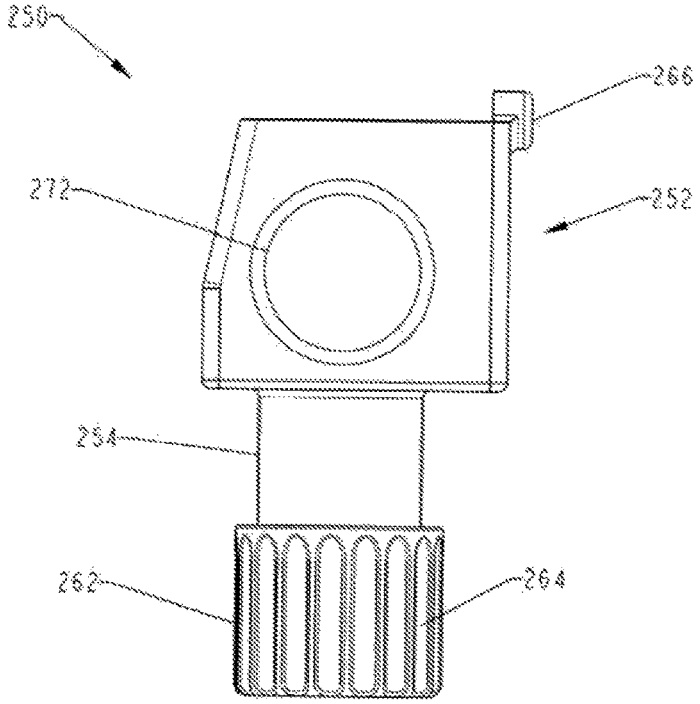
FIG. 12 is a side view of the magazine clamp assembly.

FIG. 12 shows a side view of the magazine clamp assembly 250 showing the viewing window 272 where the user can confirm that the magazine 220 is sufficiently clamped in the loader assembly 10. A knob 262 has finger grip features 264 to enhance the user's ability to grip the knob.

Figure 13:
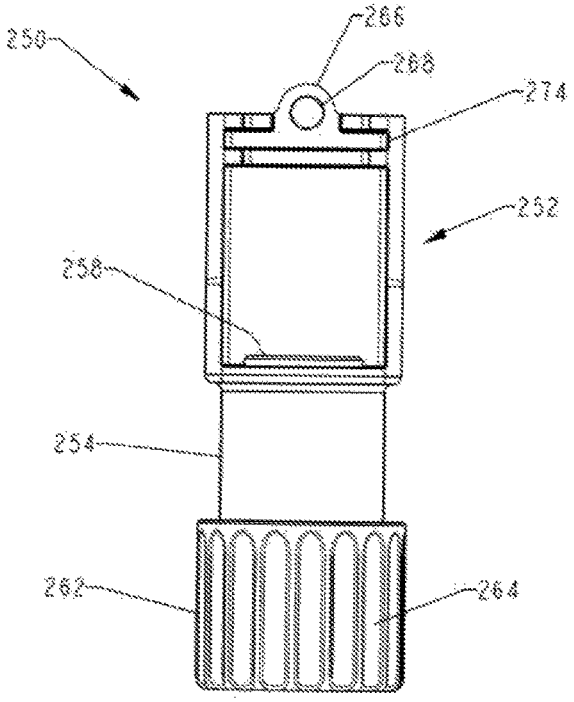
FIG. 13 is a rear view of the magazine clamp assembly.

FIG. 13 shows a rear view of the magazine clamp assembly 250 with the loader body flange slots 274 that help to guide and engage the magazine clamp assembly 250 with the loader assembly 10.

Figure 14:
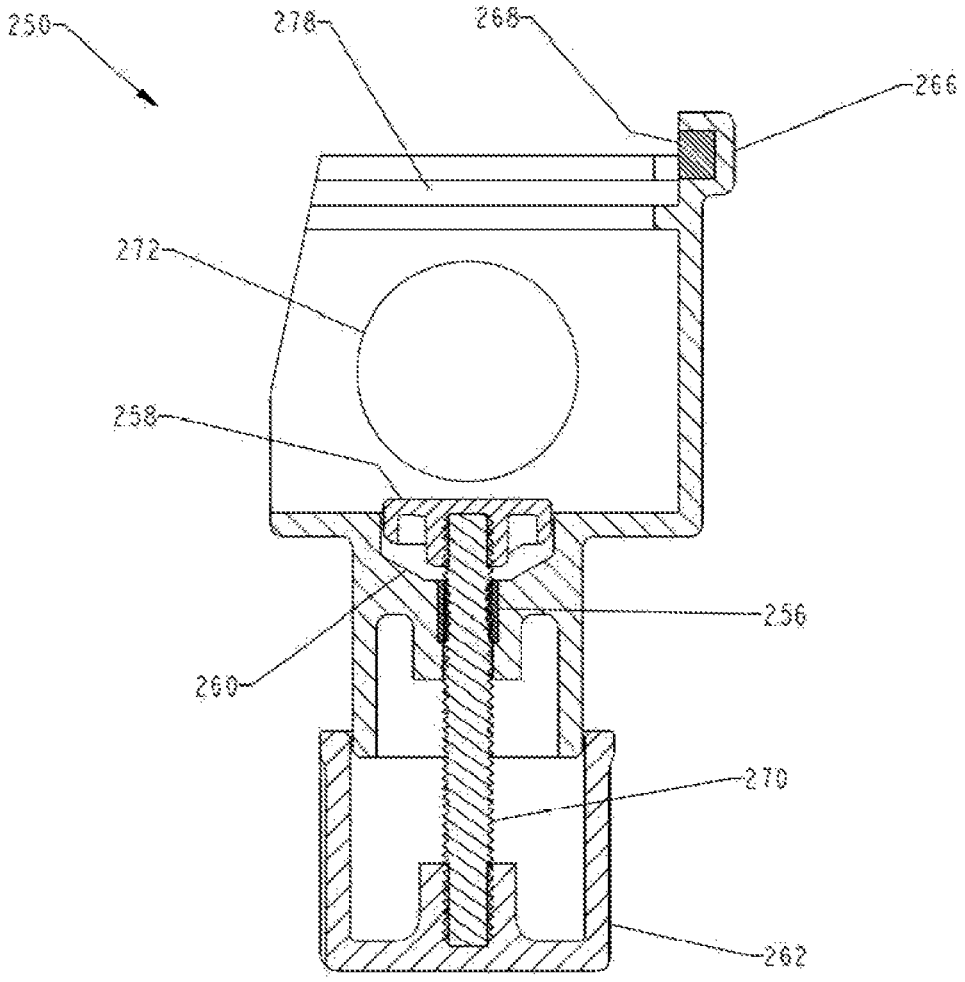
FIG. 14 is a cross section view of the magazine clamp assembly.

FIG. 14 shows a section view wherein a threaded metal rod 270 is interconnected to both the clamp knob 262 and clamp pad 258. The intended method of manufacture for this clamp body is by means of conventional plastic injection molding. Plastics do not typically hold up well to repeated use of threading and unthreading between metal and plastic parts, so a threaded insert 256 is embedded in the plastic to provide a longer life expectancy for this product.

Figure 15:
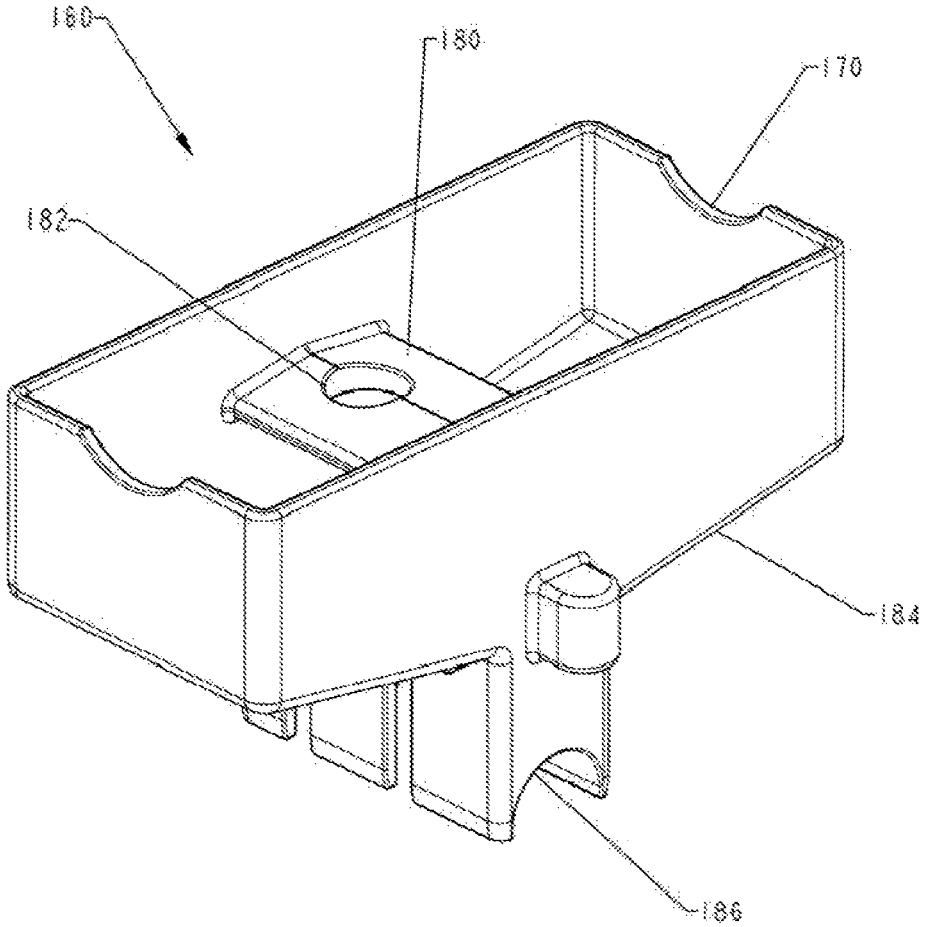
FIG. 15 is a frontal perspective view of the cartridge hopper.
Figure 16:
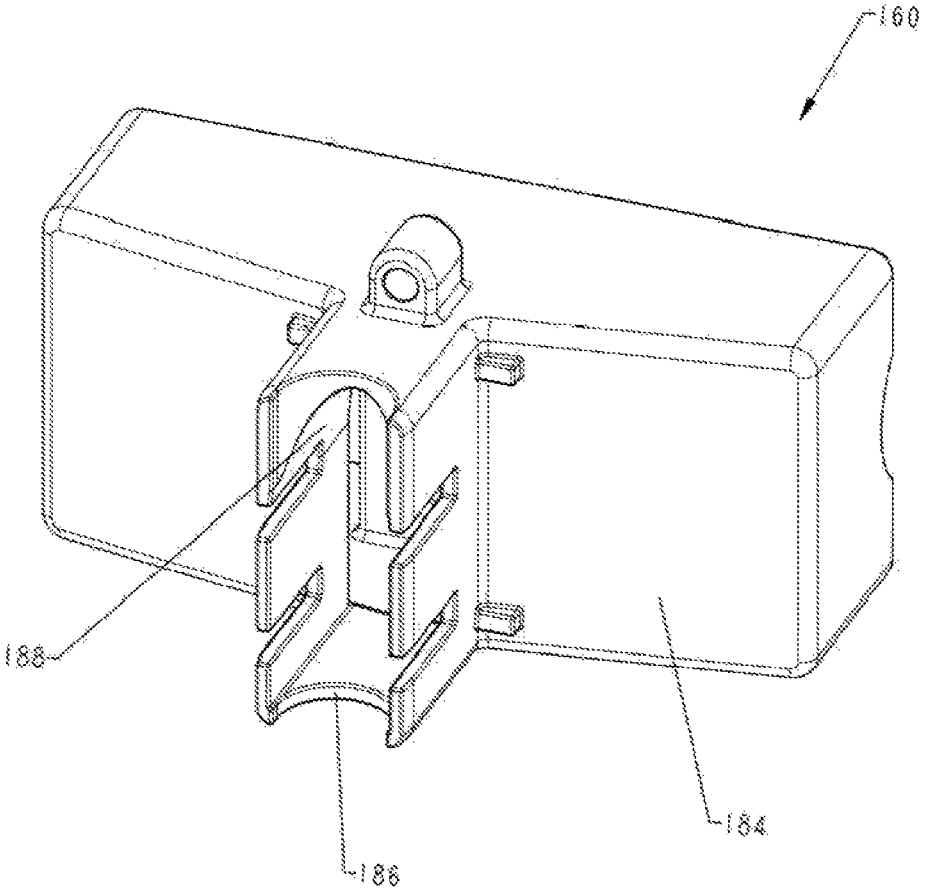
FIG. 16 is a bottom perspective view of the cartridge hopper.
Figure 17:
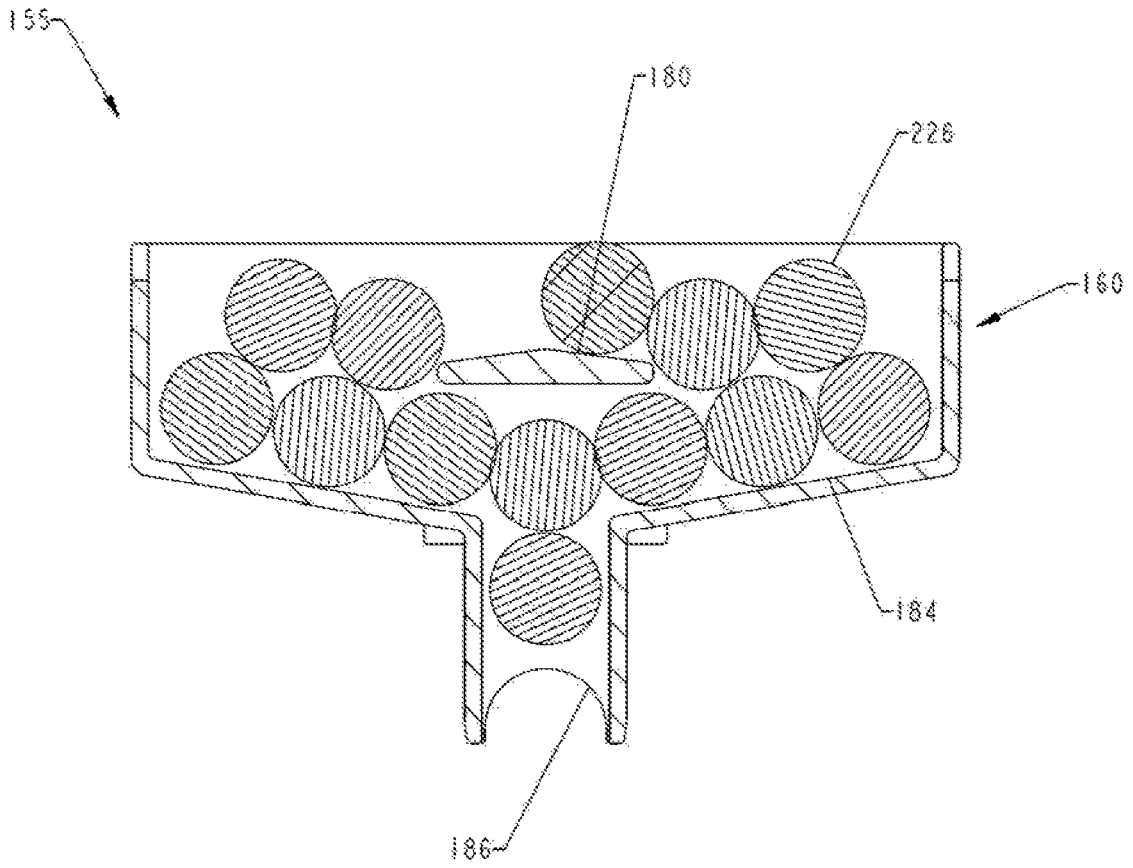
FIG. 17 is a cross section view of the hopper with cartridges loaded in the hopper.

FIGS. 15-16 show front and bottom views of the cartridge hopper 160, respectively. FIG. 17 shows a cross section view of the hopper 160 with cartridges 229 loaded in the hopper. Ramp 184 is inclined to cause cartridges to slide under gravitational force to an exit hole 188. A ceiling (baffle) 180 is placed to limit stacking on the ramp to a single cartridge layer. View hole 182 allows the user to see cartridges under the baffle 180. A semicircular channel 186 allows motion of the plunger 190 directly under the exit hole 188.

Various features that are unique to each individual firearm brand and model number may be added or removed and even modified to accommodate the physical requirements of the particular firearm and magazine.

Material savers are used throughout the mechanical design to enhance the ability to use conventional plastic injection molding as the preferred method of manufacture for the loader body 20, vertical plunger 130, horizontal plunger 190, and cartridge hopper 160. Some examples of this are illustrated with features 148, 200 on the vertical plunger 130 and horizontal plunger 190, respectively.

Ribs in the frontal lateral interior surfaces of the cartridge hopper 160 will prevent the wider rear end of a cartridge 226 from accidentally being inserted into the cartridge hopper 160 in the wrong direction. That being said, some firearms are design to eject a cartridge if it is inserted in the wrong direction, and in other firearms, the cartridge will jam. Cartridges can be inserted into a magazine in the wrong orientation regardless of the apparatus used. The user should ensure that all cartridges have been oriented properly prior to loading the magazine. To assist the user, the apparatus may be equipped with a loading template (not shown) that will not permit cartridges to be loaded into the hopper unless in the correct orientation.

Various markings around the apparatus like 30, 92, and 32 indicate where the magazine 220 is to be inserted, where the cartridge(s) 226 and/or cartridge hopper 160 is to be inserted, and what brand and model firearm is compatible with this apparatus, respectively.

Principles and features of the manually operated SLFMs 10, 15 shown in FIGS. 1-17 may be adapted for motorized operation to provide a motorized SLFM 500 to help firearm users more easily and quickly load magazines with cartridges. The motorized SLFM 500 can be designed to either accommodate only unique magazines or it can be designed to accommodate a large variety of different magazines. The apparatus and components illustrated in FIGS. 18-35 are designed for magazines of uniform size and configuration, but various adaptor sleeves may be used to provide universality so that the motorized SLFM can be used with many cartridge sizes, magazine brands, and magazine capacities.

The overall function of the apparatus 500 is simple. A microcontroller 916 manages all motor and sensor functions of the motorized SLFM. Only after the power is turned on will these functions work. Upon startup, a motor drives the idler gear at least a portion of one revolution until the idler gear magnet passes by the hall sensor thus sending a pulse to the microcontroller and causing the motor to instantaneously stop at the home position.

The user can select the number of rounds they want to load either before or after the motorized SLFM is powered up as the microcontroller 916 will poll the selector switch as well. The user will then rotate a keep-down door 624 to expose a loading ramp 626 and allow the user to effortlessly place the rounds into the loading area 604, on the loading ramp, of the upper housing 600 of the apparatus with the cartridges pointing forward. The orientation of the cartridges is critical to the function of the apparatus. Failure to properly orient the cartridges may result in the cartridges jamming in the magazine during the loading process. Once the rounds are placed on the loading ramp, the keep-down door 624 is rotated back down and will lightly rest along the tops (tangent contact) of the cartridges on the loading ramp.

The user can then insert the magazine into the magazine insertion slot 622. As the magazine passes the limit switch lever 822, the rear surface of the magazine causes the lever to rotate and actuate the limit switch 800. The microcontroller 916 continuously polls the limit switch, and closure of the limit switch signals the microcontroller to start driving the motor 706. The motor 706 may comprise a servomotor, gearmotor, stepper motor or any other suitable motor.

As the motor 706 rotates, the small drive pinion gear 742 that is mounted to the motor shaft will drive the idler gear 708. Configuration of the gears (e.g. gear ratio) provides a mechanical advantage which enables the apparatus to use a relatively small motor along with a gear train to provide the large torque needed to drive the cam 764 against the cam roller 772 that is pivotably connected to the vertical plunger 774. As the vertical plunger is pushed in an upward direction the outer diameter of the vertical plunger 774 translates in a lubricious bushing, and the reaction force from the vertical plunger return spring and the magazine follower spring push back on the vertical plunger 774. Together, the cam 764, cam roller 772 and spring 780 make up a reset mechanism for resetting the vertical plunger after inserting of a cartridge. A plastic tip may be fixed at the top end of the vertical plunger to eliminate metal vertical plunger contact with FMJ (full metal jacket) rounds. As more rounds are loaded into the magazine, the force linearly increases. The "lean-back" angle of the vertical plunger is critical to the function of the motorized SLFM. Without the "lean-back" angle, retraction of the vertical plunger 774 will tend to pull the newly loaded cartridges out of the magazine by means of friction and potentially causing an obstructive jam. The lean-back angle shown in the FIGS. 18-35 is 18 degrees. Useful lean-back angles should depend on the design of the magazine among other factors and are believed to lie within a range of about 15 to 25 degrees.

As rounds are pushed into the loading hole by the plastic horizontal plunger 716, adjustable spring-loaded plungers on either side of the magazine housing assembly lightly contact the rounds and help to ensure that the rounds stay laterally centered so that they don't accidentally contact the front edges of the magazine body causing the rounds to "hang up".

After the rounds pass the lateral spring-loaded plungers, a pair of optical sensors 758, 768 (e.g., an infrared (IR) transmitting module and a complementary IR receiving module) detect obstructions across the loading hole of the magazine housing assembly to ensure that no previously inserted round is obstructing the insertion of the incoming round into the magazine. If an obstruction does exist, then the motor will immediately halt and then reverse direction to the idler gear home position.

The idler gear 708 and idler arm 752 rotate in perfect synchronicity as they are connected to a common cam shaft 768 on opposite sides of the magazine housing assembly 520. The links are connected to pivots on both the idler gear and idler arm which provide for force-balanced linear reciprocating oscillation of the horizontal plunger 716. As the motor turns, the processes of cam rotation driving the vertical plunger 774 and idler gear and arm rotation driving the horizontal plunger provide all of the required forces to push the magazine follower or previously inserted round up to make room for an incoming round to be horizontally pushed into the magazine.

Based upon the user-selected number or rounds to be loaded, the microcontroller 916 will count the selected number of rounds as each round is loaded into the magazine, and the motor will stop rotating after the idler gear returns to home position after the last round is loaded into the magazine.

Safety is paramount. With that in mind, all of the components that contact the rounds are either coated with or made entirely of plastic or rubber isolation materials to eliminate any possibility of arcing which, however low the statistical possibility of causing an accidental discharge, could possibly increase the likelihood of an accidental discharge.

The use of firearms requires great care and practice of safe operating standards and procedures. Safety is paramount while handling, loading, and especially firing any types of guns. A great deal of thought has been put into the inventive process relating to the seemingly benign and harmless act of loading of cartridges into magazines to further enhance the safe use of firearms for everyone.

Electronic circuits are not shown in detail in this patent application. It should be understood by somebody skilled in the art that a power supply provides power to the electrical system for this apparatus, and that the wire leads from the limit switch, hall sensor, and optical sensors may be all connected to a microcontroller running a control program stored in electronic memory. Features and operations of the motorized SLFM having been generally described, certain details will be pointed out in connection with specific figures.

FIG. 18 show opposing perspective views of a motorized SLFM. The overall design is relatively rectilinear, which is merely aesthetic. The upper housing 600 and lower housing 900 may be as compact as possible to enclose the internal magazine housing assembly 520. The housing 600 may include a storage reservoir 602 for bulk cartridges in the frontal area of upper housing 600. A magazine insertion slot 622 may accommodate different capacity magazines (e.g. 7, 8, 9 rounds . . . ). A main power switch 608 turns on the main power for the unit A number-of-rounds selector switch 616 with selector knob 618 enables the user to select 1, 7, 8, or 9 bullets. These quantities are general and can be changed to accommodate various capacity magazines and brands. For example, if the user sets the loading quantity to 7 and then realizes that they were loading a 9-round magazine, then they can rotate the selector switch to 1 round and insert the magazine 2 more times to load the additional 2 cartridges. In an aspect, each time the user actuates, de-actuates and then re-actuates the limit switch 800 by inserting, removing, and re-inserting the magazine 540, the apparatus will load another round into the magazine 540.

The cartridge loading ramp 626 enables inserting cartridges 555 into the apparatus so that they individually roll down the cartridge loading ramp 626 and into the loading chamber 736 of the magazine housing assembly 520.

The loading ramp angle 628 is critical in the loading of rounds into the loading chamber 736. If the loading ramp angle 628 is too small, the rounds will not have enough potential energy to roll into the loading chamber 736. If the loading ramp angle 628 is too large, then the rounds might tend to "leapfrog" over one another and potentially lead to a jam. The cartridge keep-down door 624 alleviates this issue. See FIG. 34 for a cross-sectional view showing the ramp angle 628 having a value of 25 degrees. Depending on materials, surface textures, cartridge mass, cartridge size, and speed of operation, useful ramp angles may be empirically selected in a range of about 20 to 40 degrees.

A cartridge keep-down door 624 will lightly lay across the tops of the rounds 555 on the cartridge loading ramp 626 to prevent the loose rounds from jumping up and possibly piling up on one another. The rounds must roll down the loading ramp 626 in a single file in order for the motorized SLFM to work properly. Experimentation has shown that piling up rounds in the loading area 604 tends to prevent new rounds from feeding into the loading chamber 736 due to a frictional wedging effect between adjacent rounds. In some embodiments, a reciprocating weight, piezoelectric or magnetic transducer, or other vibrator may be used to agitate the motorized SLFM 500 for vibratory feeding of cartridges into the loading chamber.

At least one indicator light 620 may indicate a current status of loading cartridges into the magazine. For example, the light 620 may illuminate red while loading and then green when finished.

Figure 20:
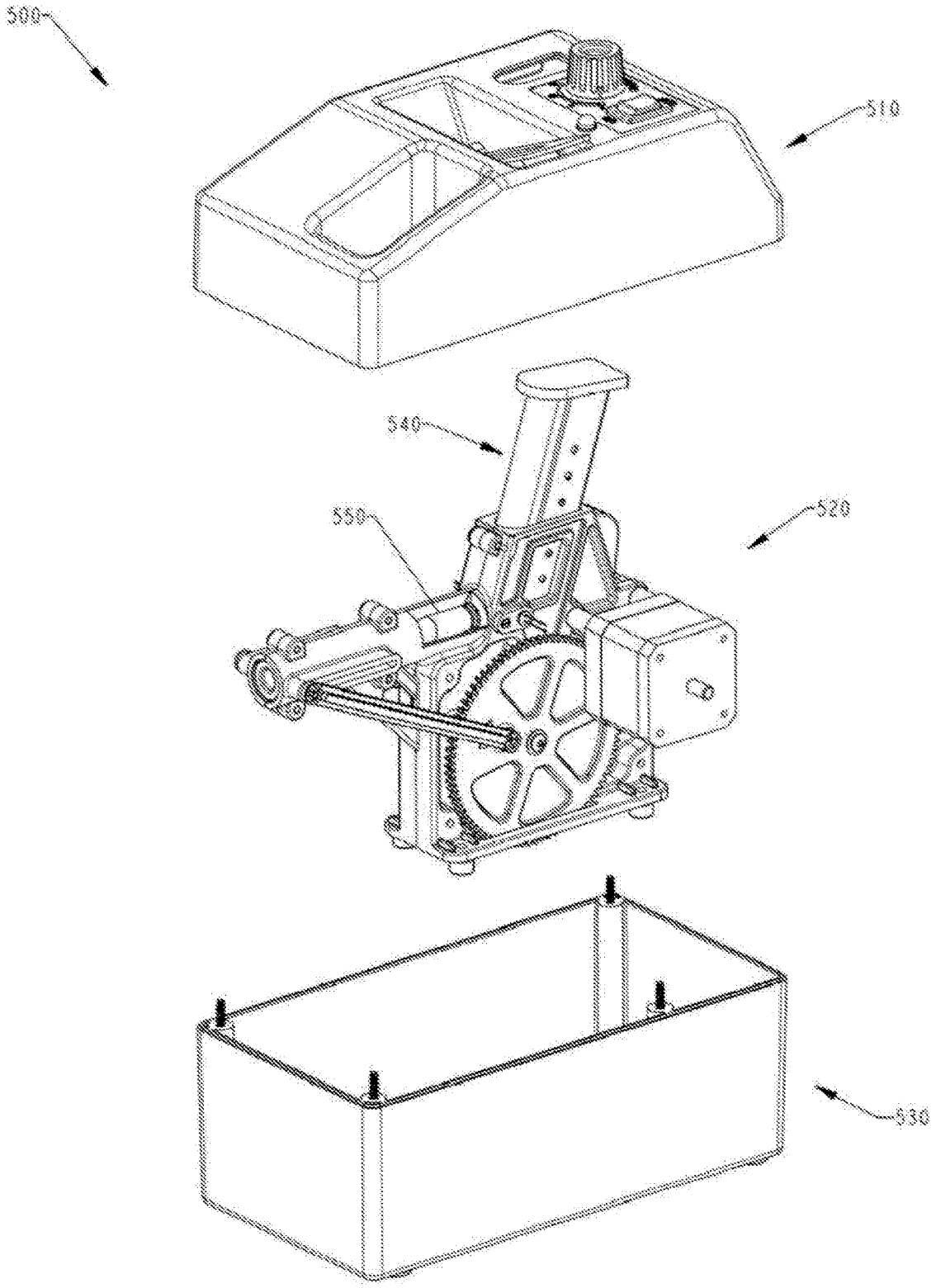
FIG. 20 is a left exploded perspective view of the motorized SLFM.
Figure 21:
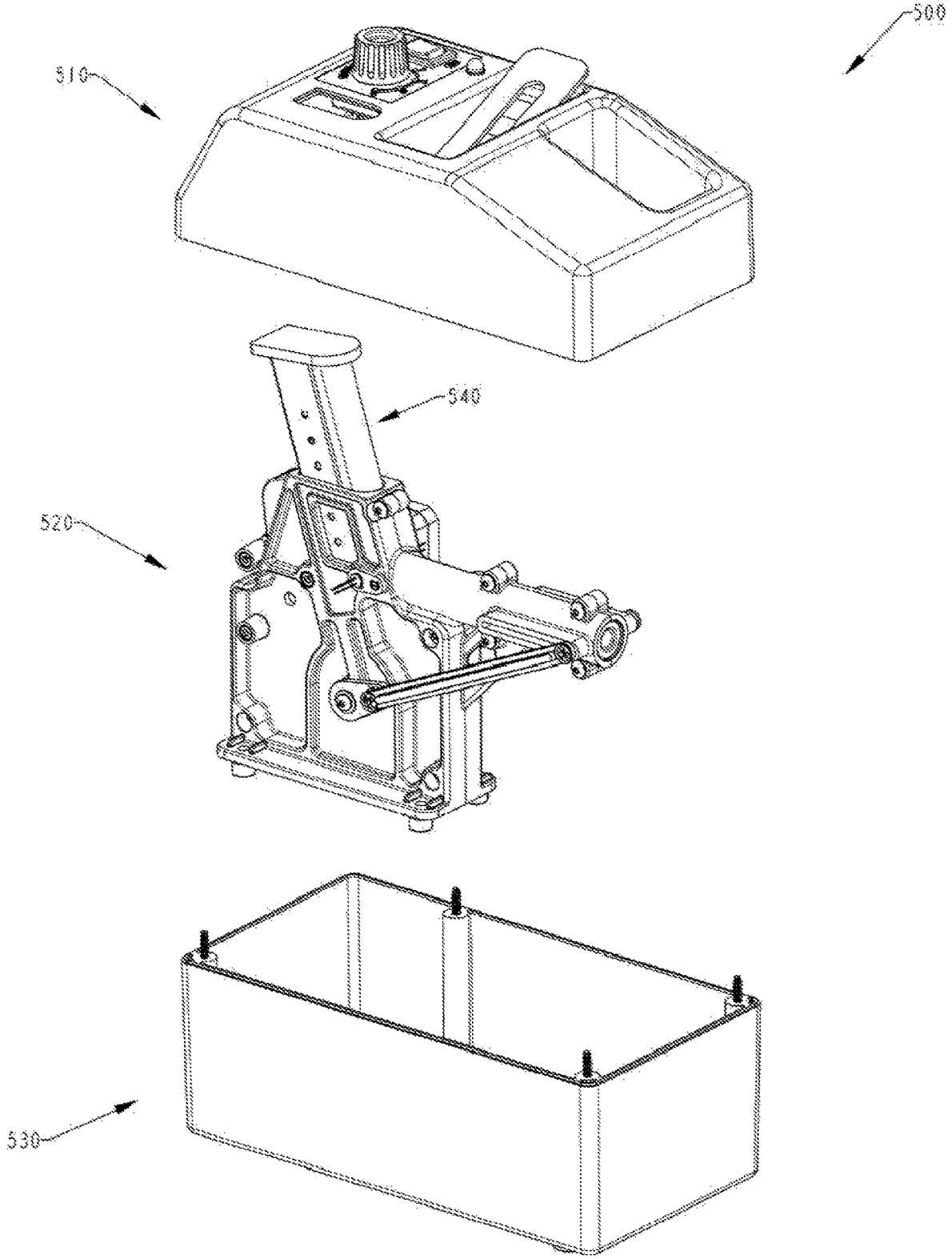
FIG. 21 is a right exploded perspective view of the motorized SLFM.

FIGS. 20-21 show opposing exploded perspective view of the motorized SLFM. The upper housing assembly 510 and lower housing assembly 530 are separated from one another exposing the main internal magazine housing assembly 520 mechanism of the Mag Loader Final Assembly 500. The motor 706 is on the left side of the magazine housing assembly 520.

The motor 706 drives a drive gear 742 which, in turn, drives the large idler gear 708 on the left side of the magazine housing assembly 520. This provides a great deal of mechanical advantage so that the cam 764 can ultimately push the vertical plunger 774 in an upward direction with sufficient force to counter the follower spring 794 reaction force of the magazine 540. As more cartridges are loaded into the magazine 540, the follower spring 794 is more compressed and the reaction force increases linearly (e.g. F=kx).

The identical left and right links 710,746 on both left and right sides of the magazine housing assembly 520 are pivotably connected to the idler gear 708 (on left side) and idler arm 752 (on right side). As the cam 764, and thus the connected cam shaft 768 rotate, the links 710,746 variably control the speed of the horizontal plunger 716. The horizontal plunger 716 with cartridge centering feature 718 pushes against the tip of each round 550 through the loading hole 738 and into the magazine 540 with precise predetermined timing. In fact, the vertical plunger 774 retracts immediately prior to the rear end of each new round 550 colliding with it. This action is enabled by the engineered shape of the cam 764 (i.e. cam profile). Together, the idler gear 708, links 710, 746, pivot connection pin 712 and retaining ring 714 make up a slider-crank mechanism for returning the horizontal slider, and for driving it forward.

Figure 22:
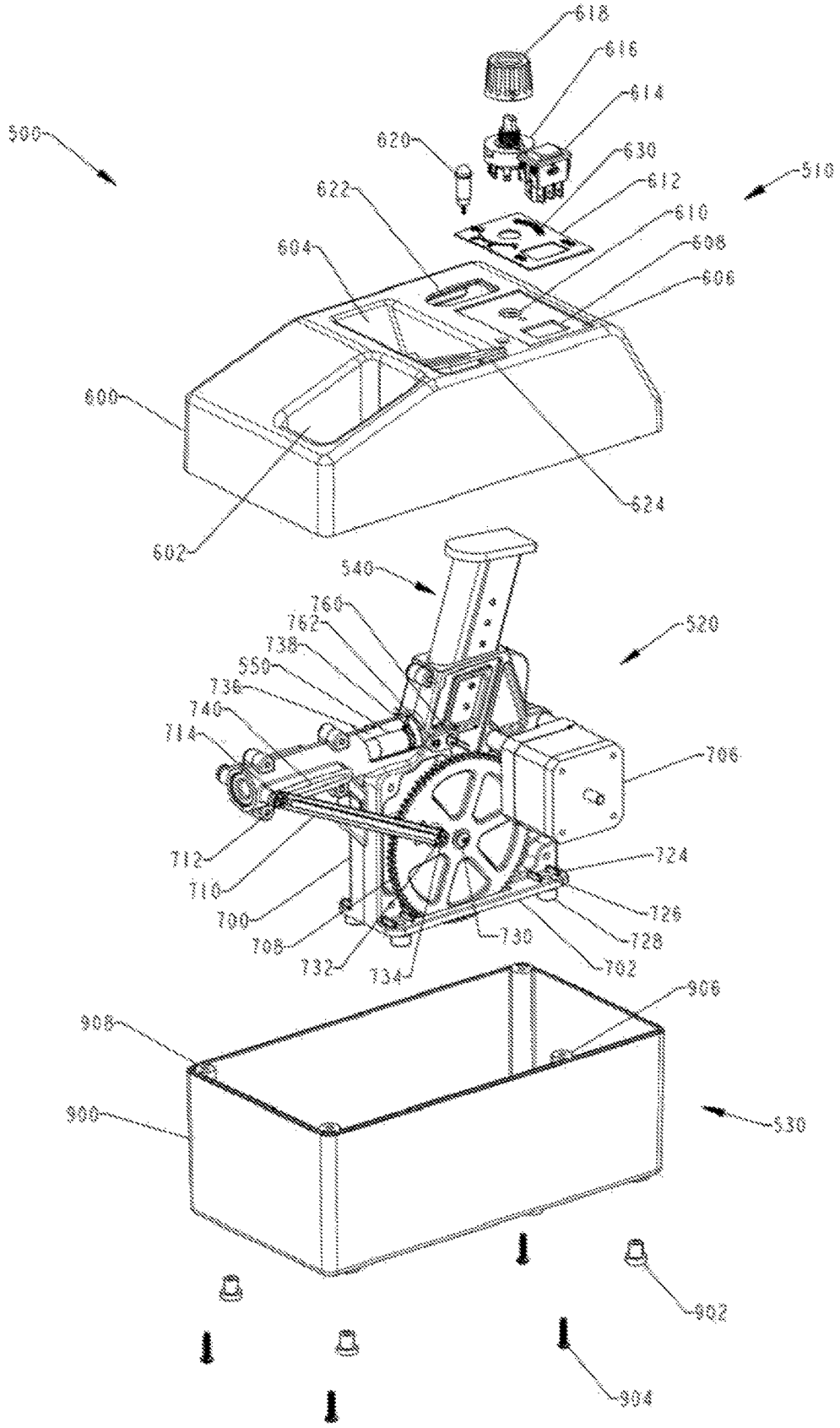
FIG. 22 is a left enhanced exploded perspective view of the motorized SLFM.

FIG. 22 is a left enhanced exploded perspective view of the motorized SLFM. The selector switch 616 and selector knob 618, on/off switch 614, indicator light 620, and lens 612 may be separated from the top surface of the upper housing 600. A separate lens 612 allows the graphics 630 to easily change without having to make an entirely different upper housing 600. The magazine housing assembly 520 is separated from the lower housing 900 and shown with the magazine 540 inserted.

Rubber dampers/feet 902 on the bottom of the lower housing 900 provide ability of the apparatus 500 to grip the tabletop surface during use. The dampers 902 eliminate unwanted vibration of the apparatus and reduce audible noise by isolating the motorized SLFM 500 from its surroundings during use.

Screws (shown in FIG. 34) 912 are inserted from below and screwed into nuts 914 (shown in FIG. 34). Nuts 914 are constrained by ribs 724 to prevent nuts 914 rotation for ease of assembly. Cross-section A-A slightly cuts across screws 912 and nuts 914 in FIG. 34.

Figure 34:
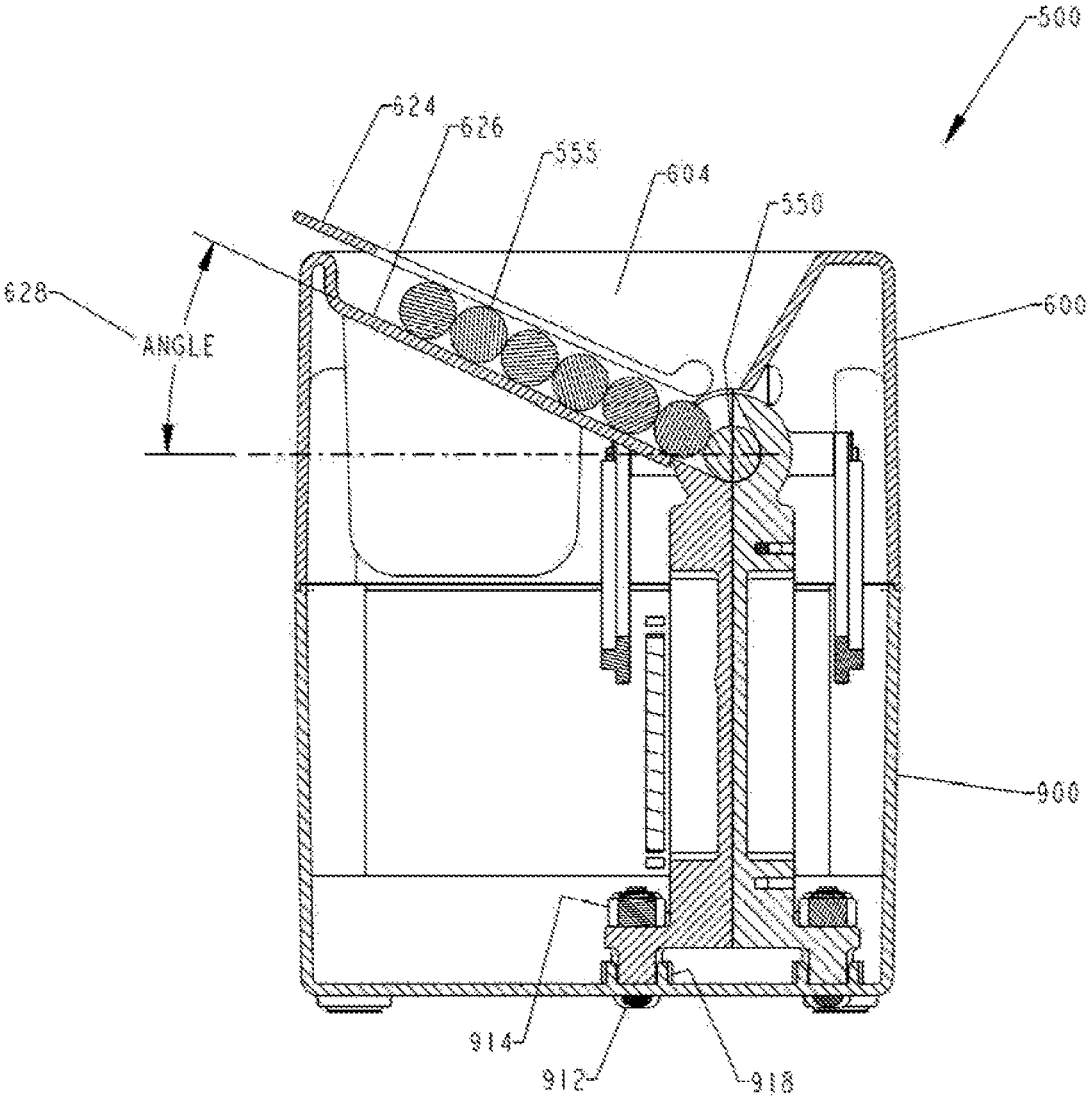
FIG. 34 is a cross-sectional view of the motorized SLFM showing how cartridges roll down a loading ramp due to gravity.
Figure 35:
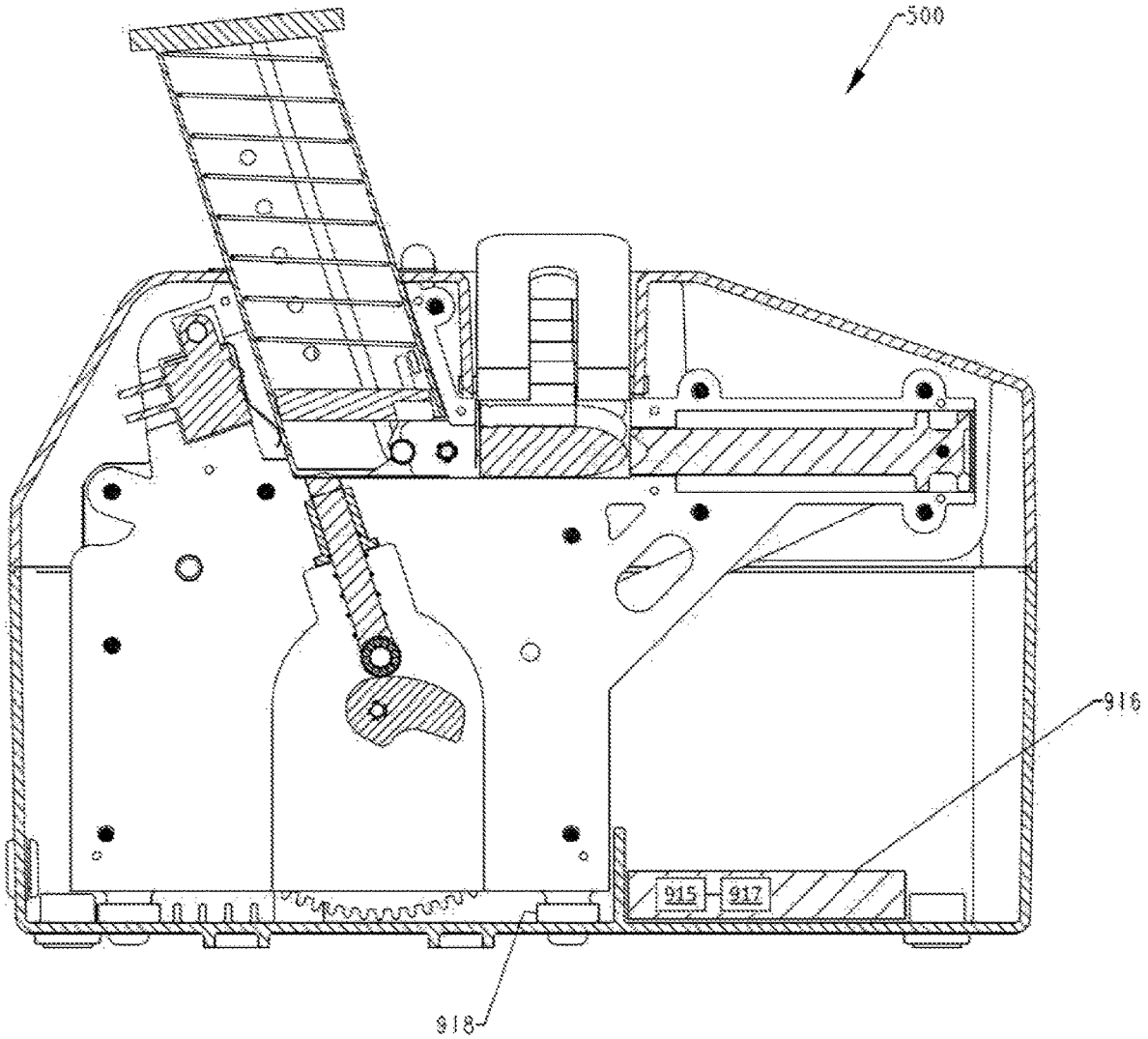
FIG. 35 is another cross-sectional view of the motorized SLFM showing other interior components.

Magazine housing assembly locating bosses 728 on bottom of left 702 and right 700 mag loader housings protrude and mate with the receiving mating bosses 918 on the inside bottom surface of the lower housing (see FIGS. 34 & 35). These features ensure proper alignment of the magazine housing assembly 520 with the magazine insertion slot 622 in the upper housing 600 as well as various other features in the motorized SLFM.

Screws 904 are used to connect the upper 510 and lower 530 housing assemblies.

Figure 23:
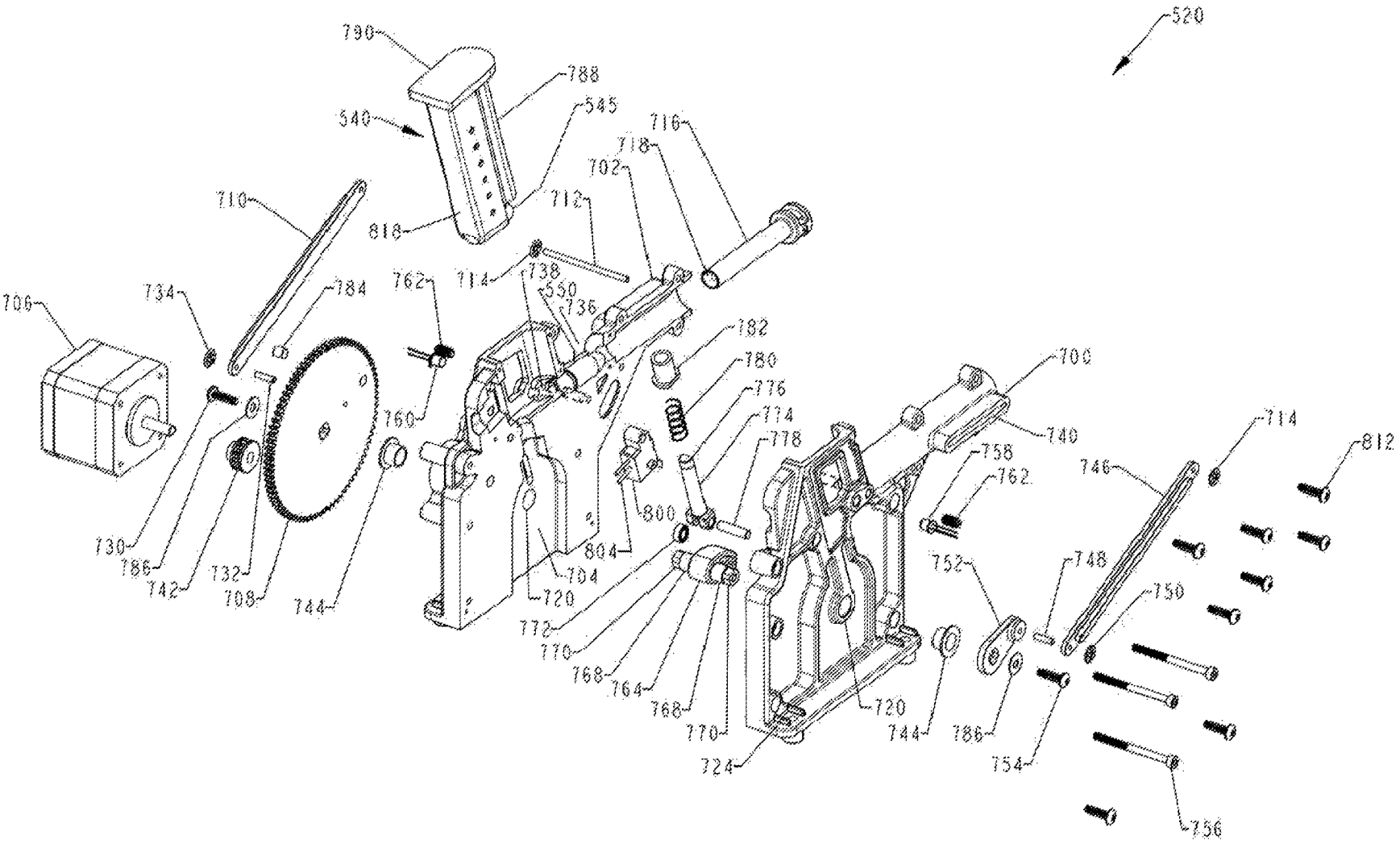
FIG. 23 is a right exploded perspective view of a magazine loading assembly used in the motorized SLFM.

FIG. 23 shows a magazine loading assembly 520 used in the motorized SLFM. Value of the "lean back" angle 816 for vertical ("first") plunger 774 (called "vertical plunger" ever though it is angled back slightly) may be critical to the proper function of the apparatus. Without the angled plunger actuation, the release of the spring-loaded vertical plunger 774 by the cam 764 would promote forward motion by friction of the incoming cartridge 550 that was just pushed into the magazine 540, essentially pulling the incoming cartridge 550 out of the magazine 540 prior to full completion of the cartridge insertion cycle and initiating a cartridge jam as the insertion process of the next cartridge insertion cycle commences.

Figure 24:
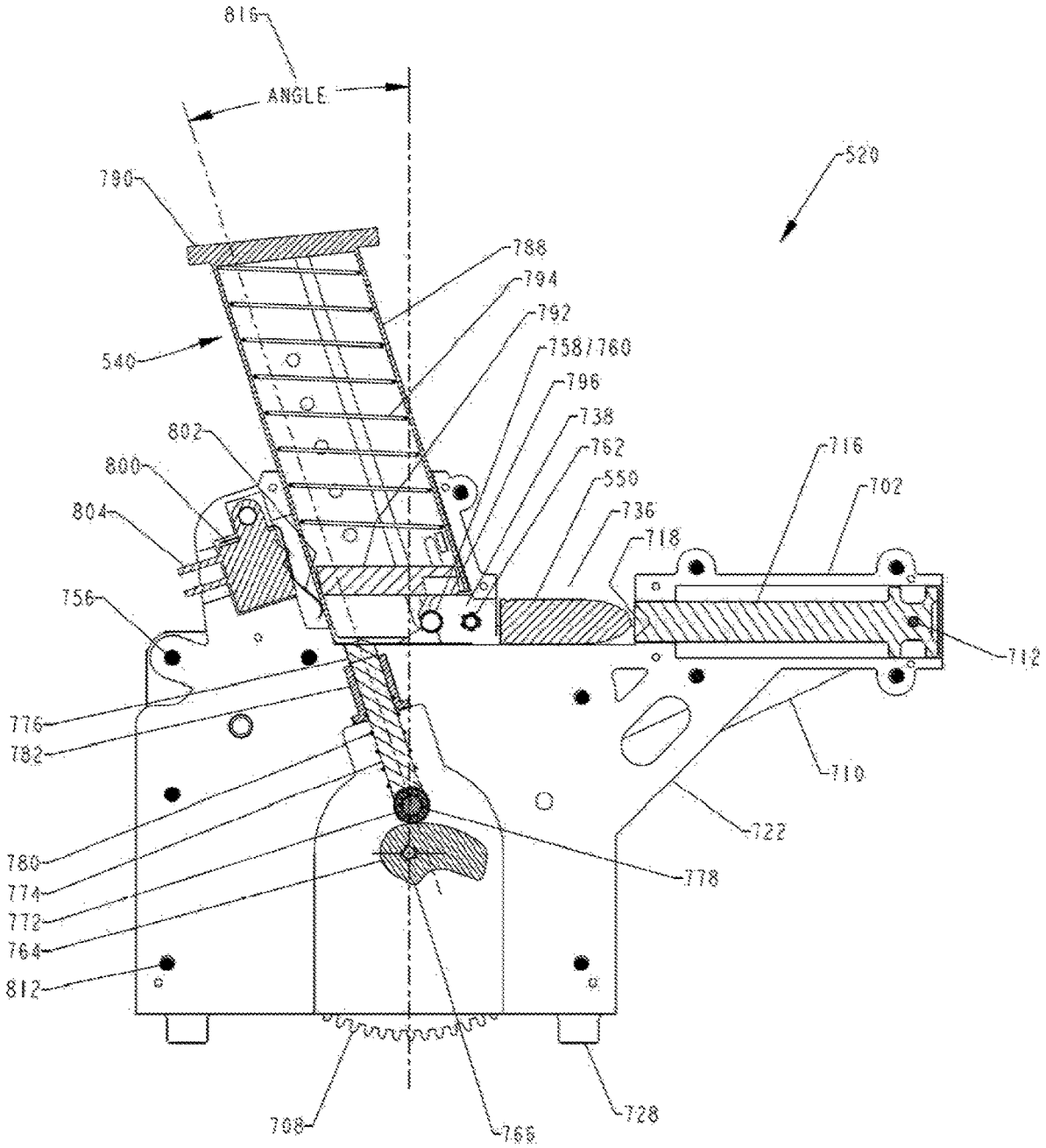
FIG. 24 is a right section view of the magazine loading assembly, showing the assembly in a home position.

FIG. 24 shows the magazine loading assembly 520 in a home position. Upon powering up the apparatus, the microcontroller 916 will run the motor 706 in a "forward" direction, counter-clockwise (CCW) when viewing the motor 706 from the output shaft side of the motor until the hall sensor 906 signals that the idler gear 708 and idler arm 752 are in home position by means of sensing the proximity of the magnet 784. The motor 706 will then stop.

A limit switch 800 will sense the insertion of the magazine 540 into the magazine housing assembly 520. Even with the power on, the device will not start the repetitive loading action of a cartridge insertion cycle until a magazine 540 is fully inserted into the magazine housing assembly 520 such that the rear surface 818 of the magazine 540 pushes down on the limit switch lever 802. The microcontroller 916 will poll the limit switch 800 and only when the limit switch 800 has been actuated will the repetitive loading process commence.

The actual home position will be determined by the hall sensor 806 and magnet 784 (not shown in this view). The magnet 784 is attached to the idler gear 708. As the idler gear 708 rotates, a hall sensor 806, mounted at same radius from the center of rotation as the magnet 784, will sense the proximity of the magnet 784 as the magnet 784 passes by the hall sensor 806. The microcontroller 916 will see a "pulse" and then stop the rotation of the motor 706 immediately. Small compensation for over-travel (i.e. if motor is unable to stop instantaneously and passes home position) can be made by rotating motor 706 in opposite direction. While a gearmotor is being used for this design, other types of motors may also be suitable, and the motorized SLFM is not limited to the use of a gearmotor. For example, in the case of a stepper motor, home position correction/compensation can be made by rotating the motor 706 several steps in the opposite direction.

With an empty magazine 540, even with the vertical plunger 774 at its highest position based upon the cam roller 772 traversing on the largest radius portion of the cam 764, the magazine follower 792 is still too low for the insertion of the first round. Therefore, follower push-up features 796 may be integrated into the left 702 and right 700 magazine housings to slightly push up on the follower 792 as the magazine 540 is pushed down into the magazine housing assembly 520.

Figure 25:
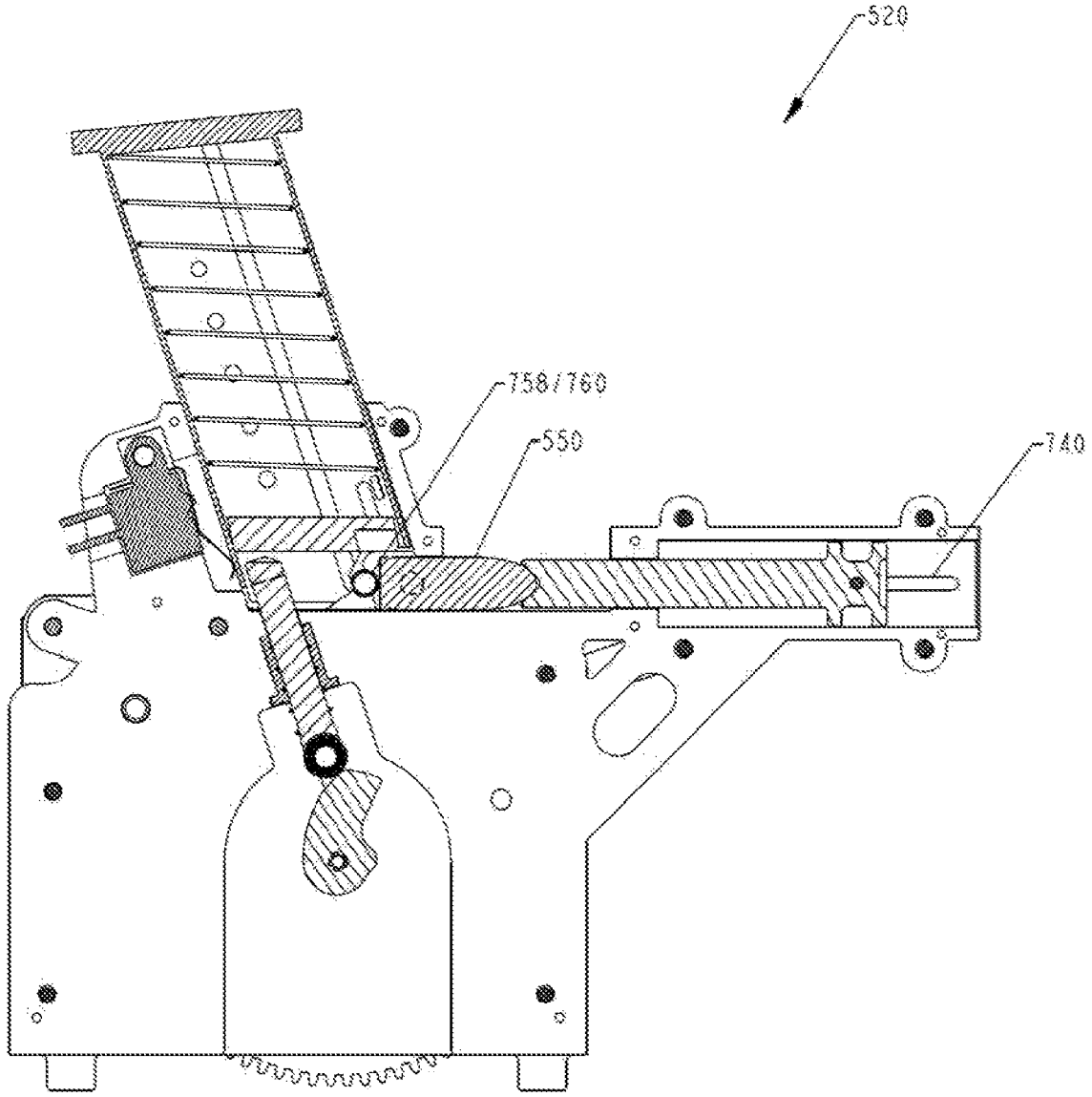
FIG. 25 is a right section view of the magazine loading assembly, showing a first round in process of being loaded with optical check to ensure that no loaded rounds will obstruct the insertion of the incoming round.

FIG. 25 shows the magazine loading assembly 520 with a first round in process of being loaded with optical check to ensure that no loaded rounds will obstruct the insertion of the incoming round. Optical emitter 760 and receiver 758 sensors are placed on opposite sides of the magazine housing assembly 520 orthogonally mounted to the axial translation of the horizontal plunger 716 and the movement of rounds from the loading chamber 736 into the magazine 540. These electronic devices 760, 758 are precisely placed to determine if any obstructions exist (e.g. previously inserted round 545 not pushed up by vertical plunger 774) immediately prior to the incoming round 550 being pushed into the magazine 540. In the event that the sensors 758,760 or any other suitable sensor, for example a current sensor measuring motor current, determine that such an obstruction exists, the microcontroller 916 will cause the motor 706 to stop rotating immediately before the rear surface of the incoming round 550 is axially forced against the tip of the previously inserted round 545 thus avoiding an unintended discharge of the incoming round 550 by the tip of the previously inserted round 545 being forced into the primer of the incoming round 550. Upon stopping, the motor 706 will reverse direction, possibly at a slower rotational speed than the normal forward rotational speed, until the home position attained. Optical sensors 758, 760 are connected to microcontroller 916.

Figure 26:
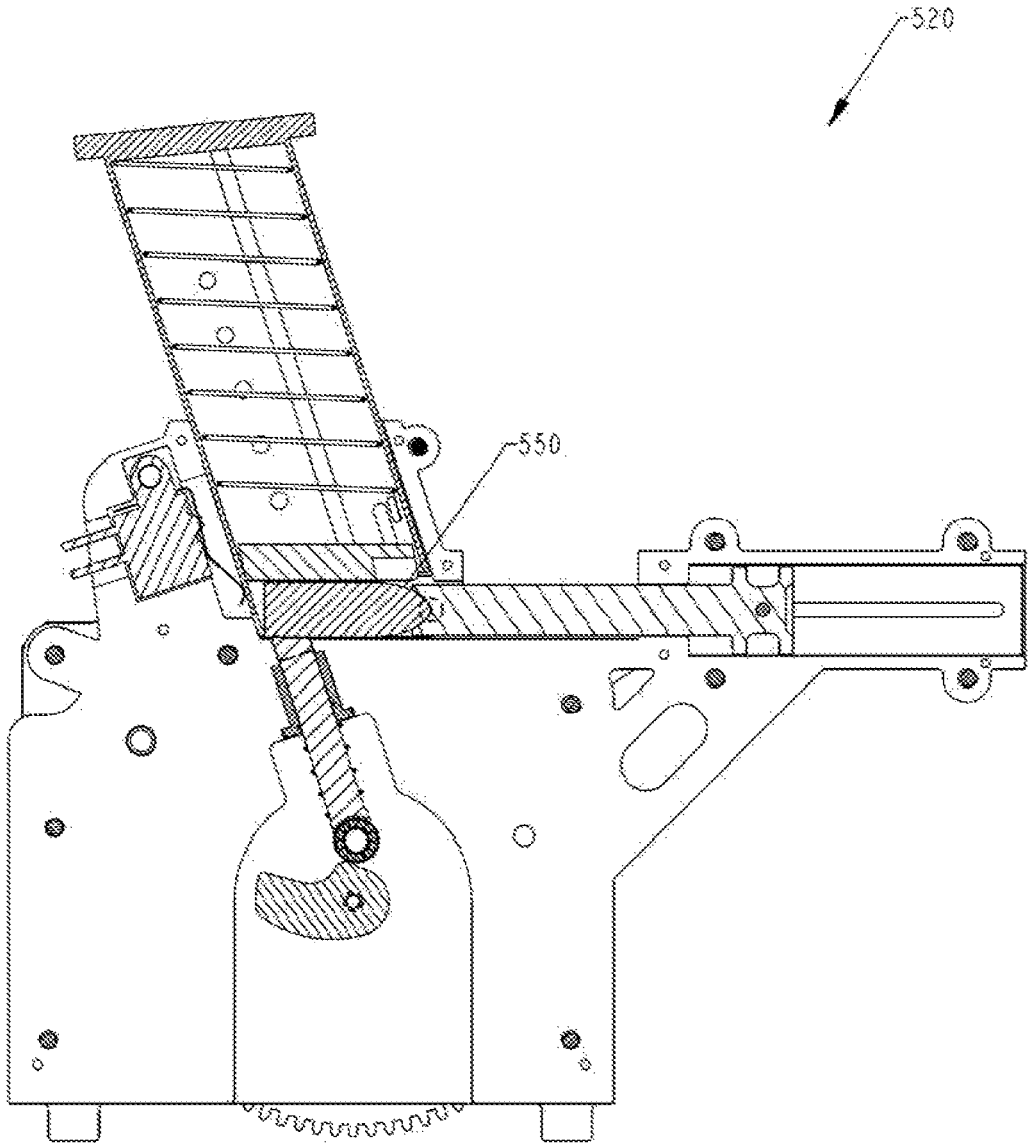
FIG. 26 is a right section view of the magazine loading assembly, showing the first round after pushed fully into the magazine.

FIG. 26 shows the magazine loading assembly 520 with the first round after pushed fully into the magazine. Once an optical check is completed based on signals from the optical sensors 758, 760 and no obstructions are indicated, the round can be pushed fully into the magazine 540.

An additional cam agitator bump 766 in the cam profile 764 agitates the round 550 slightly as it is being pushed into the magazine 540 toward the end of the cartridge insertion cycle in order to reduce some of the frictional forces acting on the round.

Figure 27:
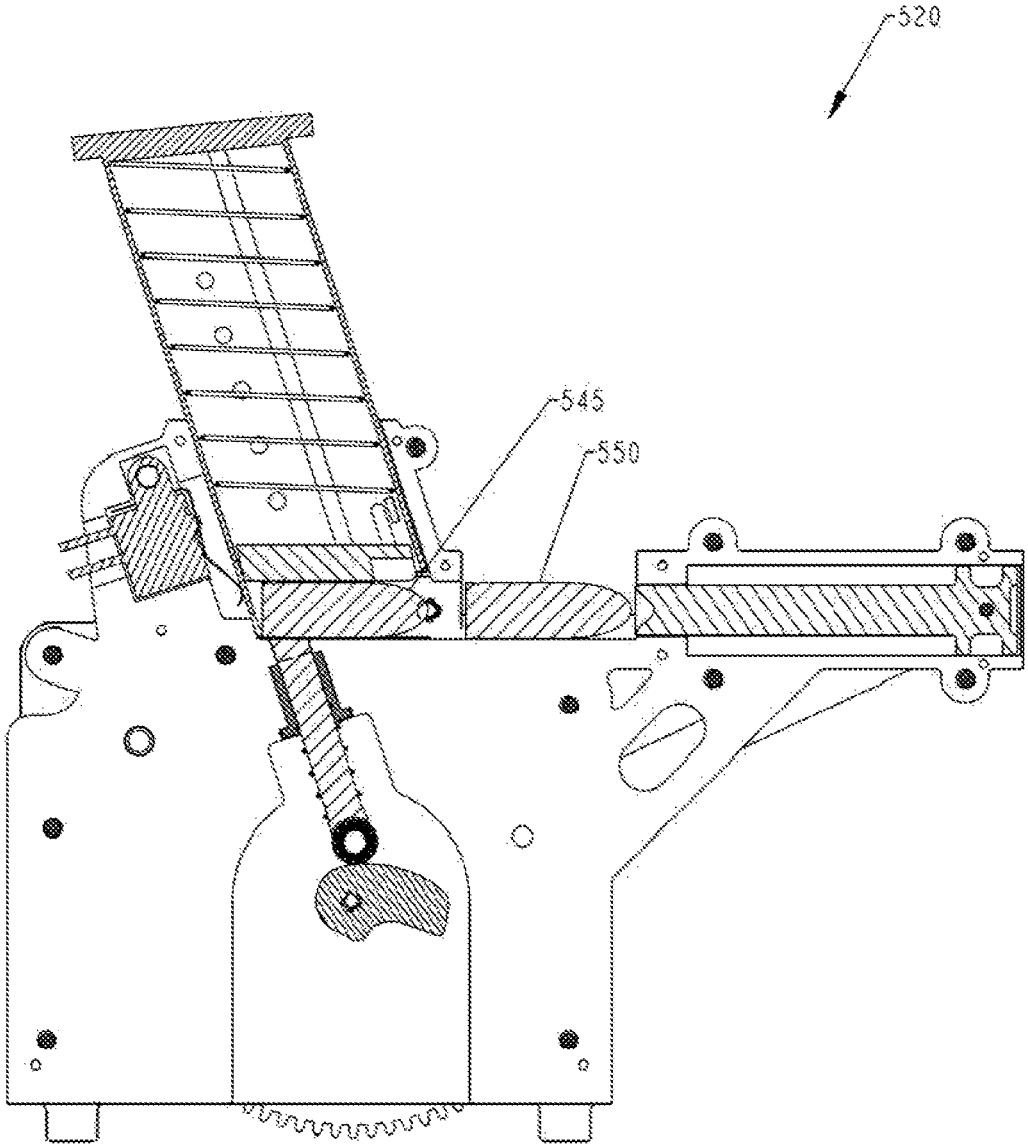
FIG. 27 is a right section view of the magazine loading assembly, showing the assembly after it returns to home position and the next round rolls from a loading ramp into a loading chamber.

FIG. 27 shows the magazine loading assembly 520 with the assembly after it returns to home position and the next round rolls from a loading ramp into a loading chamber. The same cartridge insertion cycle repeats with the exception of the magazine follower 796 issues relating to the insertion of the first round.

With rounds 2 through 9, depending on the magazine capacity, the action is identical.

As each round 550 is pushed into the magazine 540 and the apparatus returns to its home position, a new round 555 rolls down the loading ramp 626 (i.e. gravity fed) and into the loading chamber 736.

Figure 28:
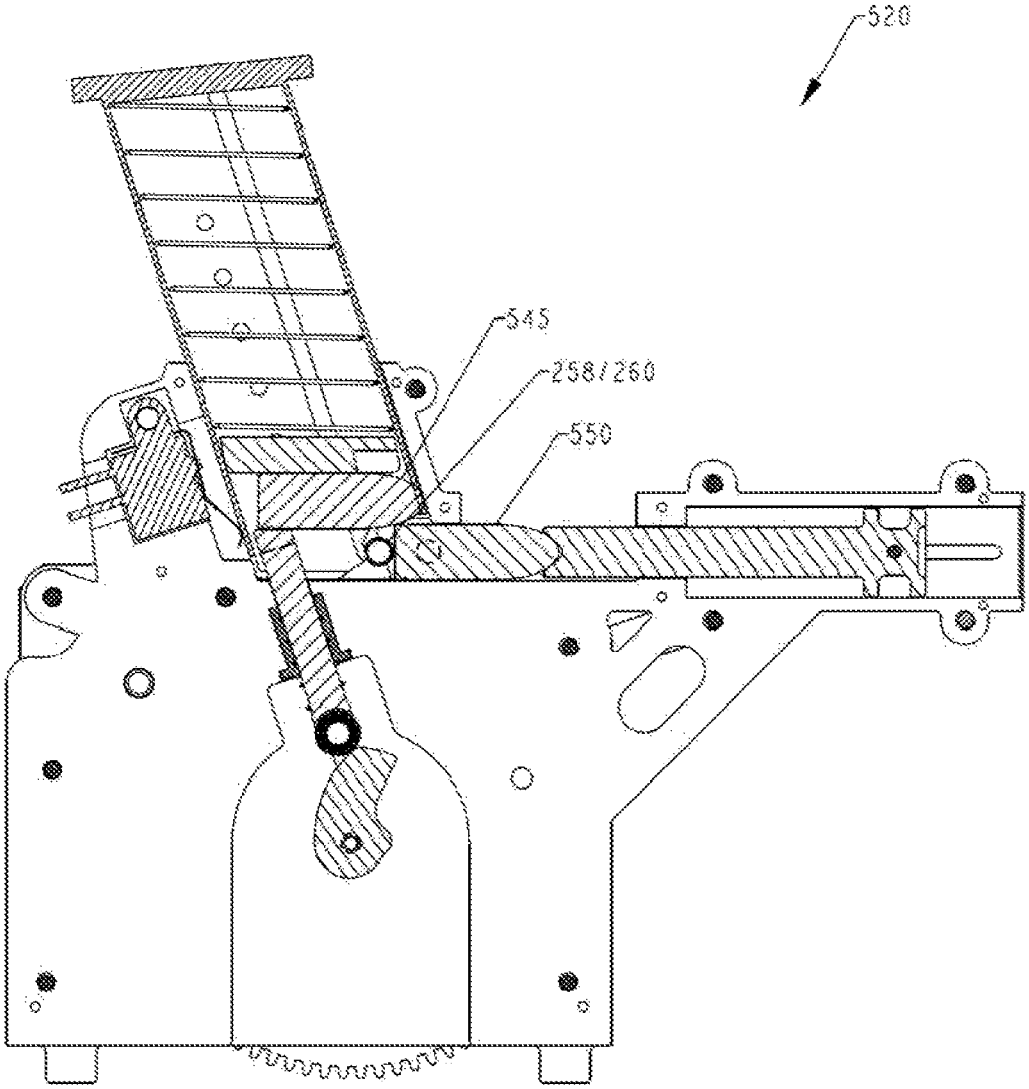
FIG. 28 is a right section view of the magazine loading assembly, showing a next round in process of being loaded with optical check to ensure the assembly is ready for insertion of the next round.

FIG. 28 shows the magazine loading assembly 520 with a next round in process of being loaded with optical check to ensure the assembly is ready for insertion of the next round. With the insertion of each incoming round 550 into the magazine 540, the optical sensor 758,760 check is repeated to ensure that no obstructions exist and that it is safe to push an incoming round 550 into the magazine 540.

Figure 29:
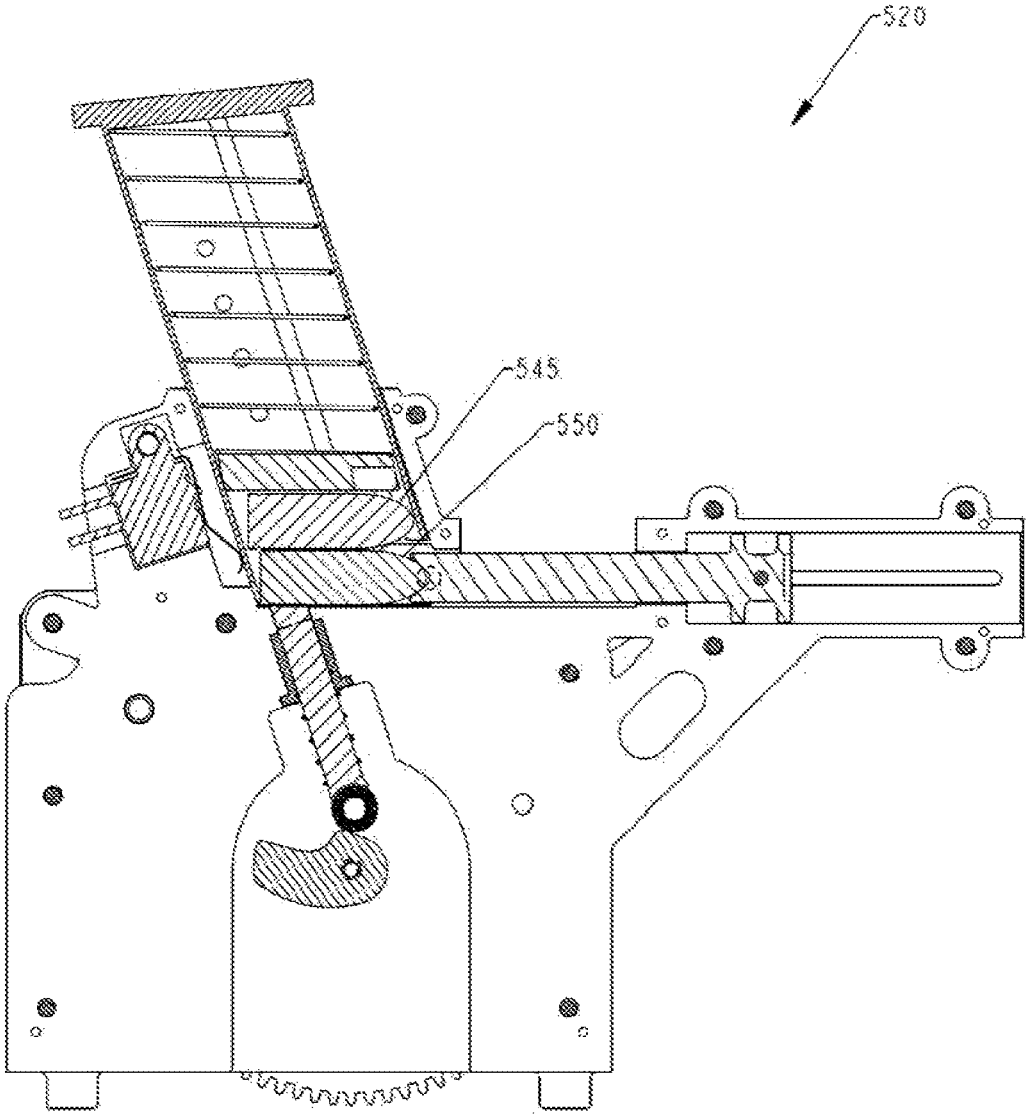
FIG. 29 is a right section view of the magazine loading assembly, showing the next round being pushed into the magazine.

FIG. 29 shows the magazine loading assembly 520 with the next round being pushed into the magazine.

Figure 30:
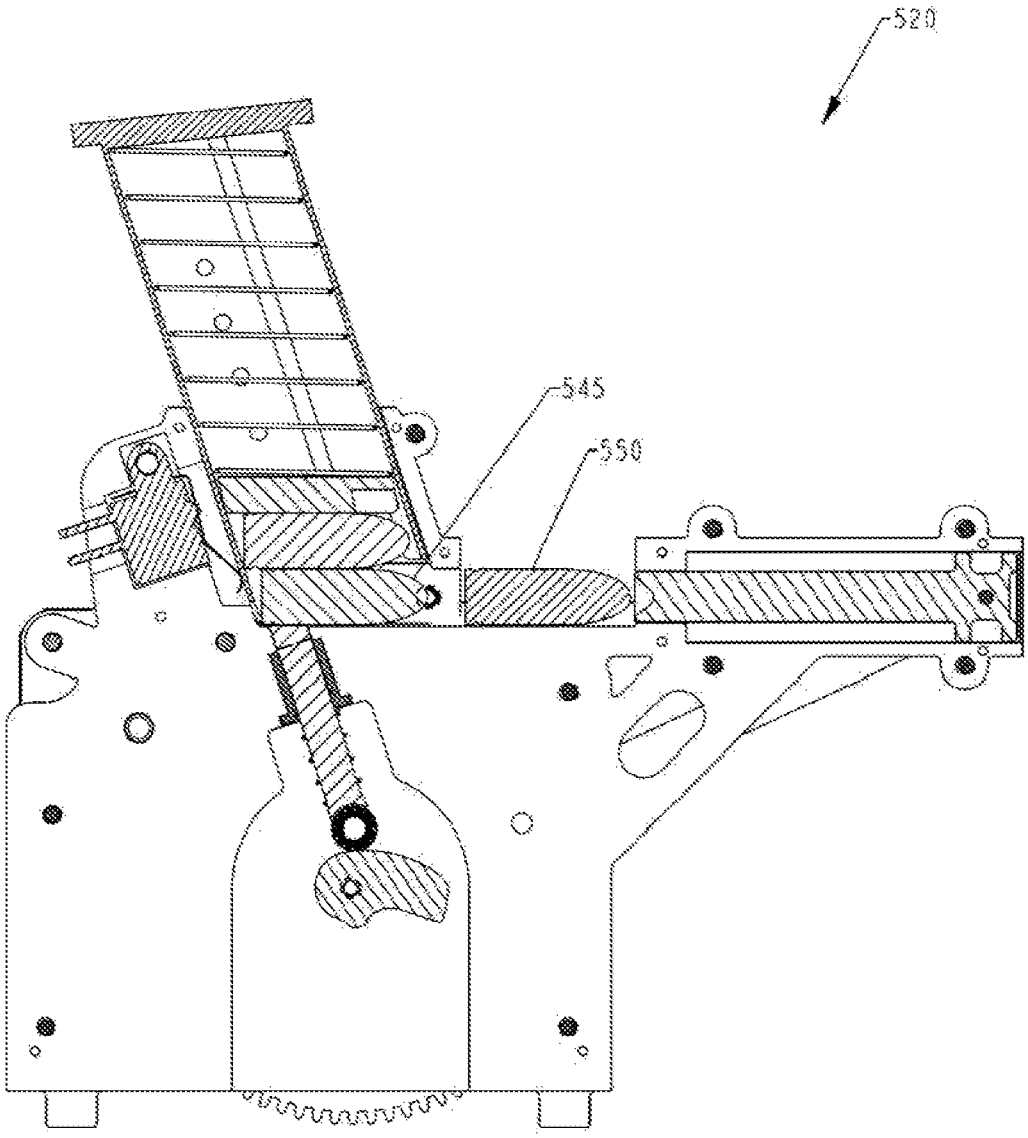
FIG. 30 is a right section view of the magazine loading assembly, showing the third round in the loading area prior to insertion into the magazine.
Figure 31:
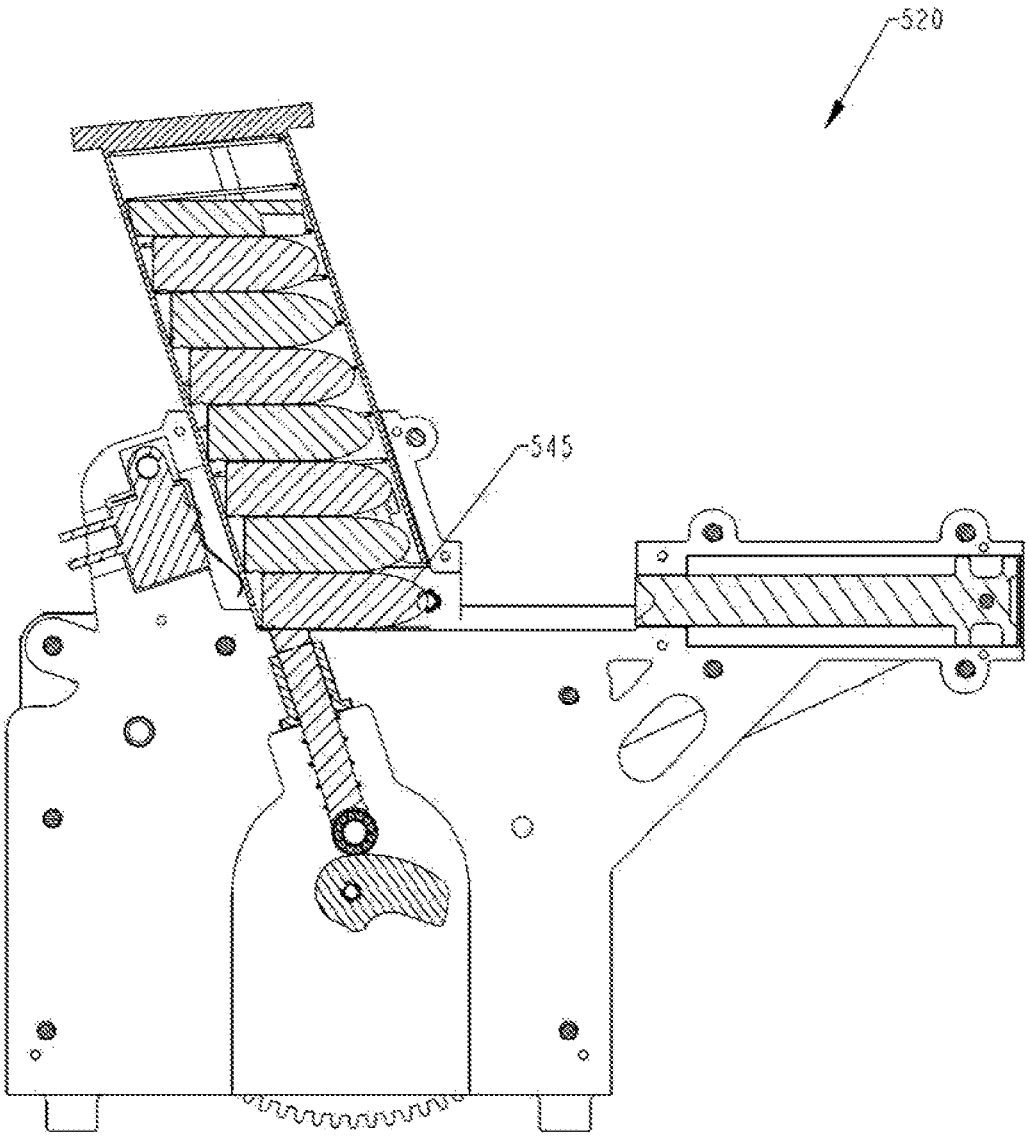
FIG. 31 is a right section view of the magazine loading assembly, showing it after the magazine is full and the assembly returns to its home position.

FIG. 30 shows the magazine loading assembly 520 with the third round in the loading area prior to insertion into the magazine. The same repetitive process occurs for round 2 through the selected capacity FIG. 31 shows the magazine loading assembly 520 after the magazine is full and the assembly returns to its home position.

Figure 32:
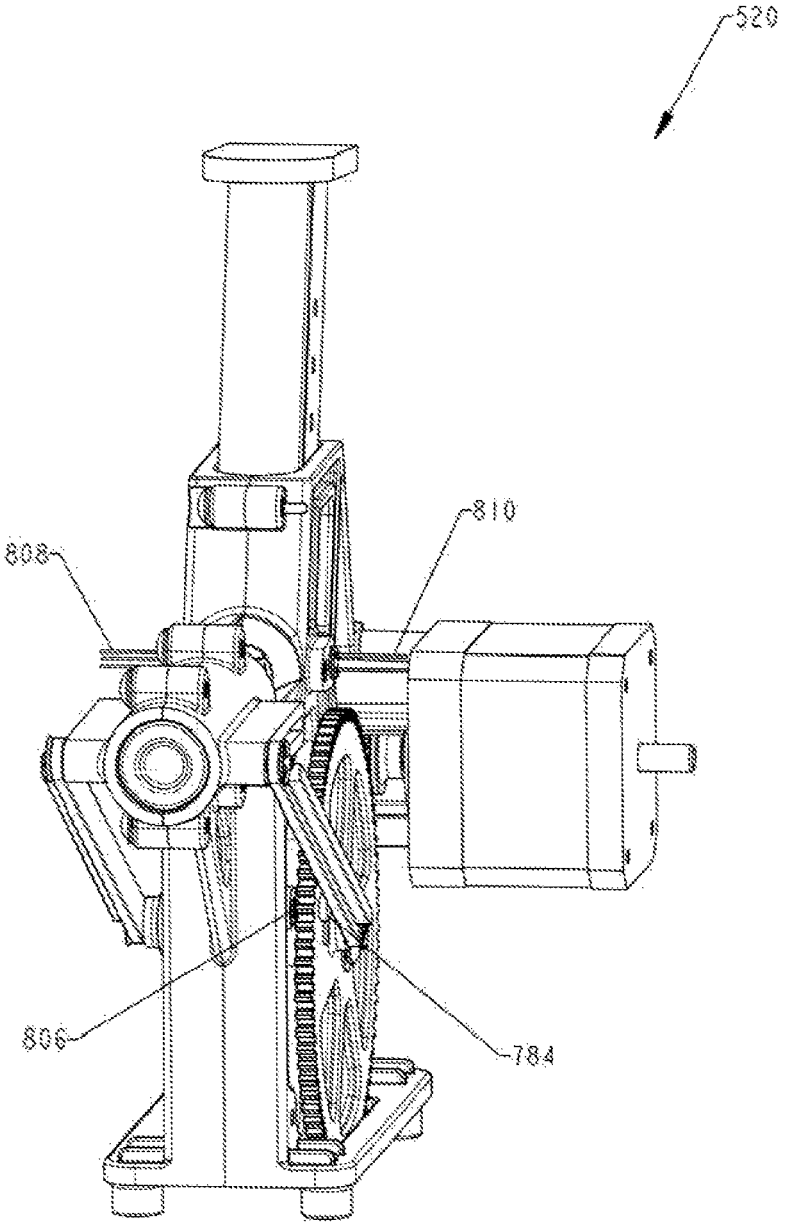
FIG. 32 is a rear perspective view showing sensor and magnet components of the magazine loading assembly, and certain other components.

FIG. 32 is a rear perspective view showing sensor and magnet components of the magazine loading assembly, and certain other components. The magnet 784 is inserted into a hole in the idler gear 708. The hall sensor 806 is mounted at the same radius from the center of rotation as the magnet 784.

With each passing rotation of the magnet 784, the microcontroller apparatus can determine if there is a jam based on signals from the Hall sensor. By reference to a stored value for timing of each revolution of the magnet 784 about the center of rotation, the microcontroller 916 can calculate whether or not the idler gear 708 has made a full rotation in a predetermined amount of time. In an alternative, or in addition, a current sensor may be used to detect a jam by monitoring motor current. If full rotation is not completed, or if motor current spikes, the apparatus is likely jammed and the motor 706 can be reversed in order to release the jammed cartridge.

Figure 33:
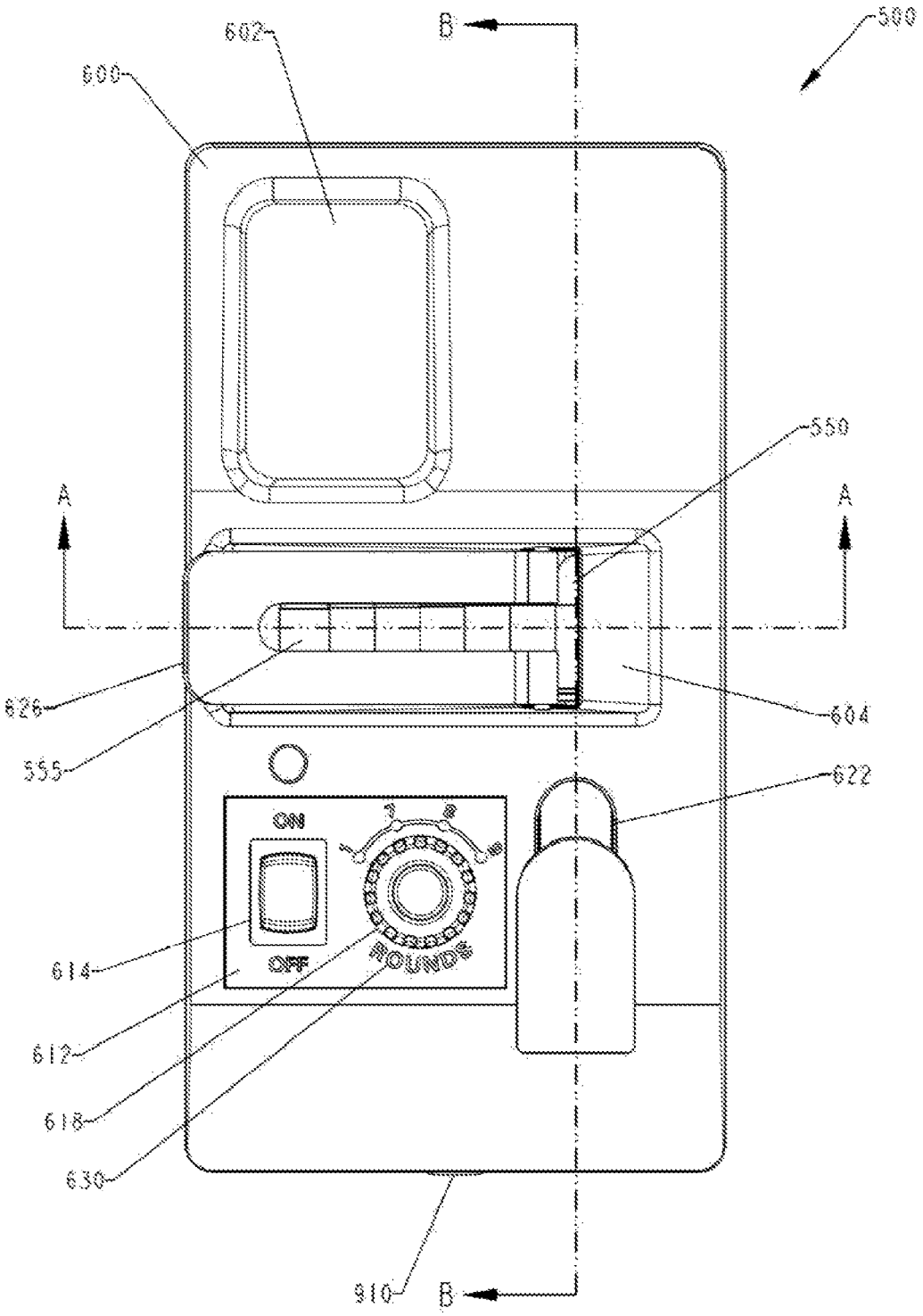
FIG. 33 is a plan view showing the upper surfaces and components of the Motorized SLFM.

FIG. 33 shows the upper surfaces and components of the motorized SLFM 500.

FIG. 34 shows how cartridges roll down a loading ramp 626 of the motorized SLFM due to gravity, the ramp angle 628, and related components.

FIG. 35 is another cross-sectional view of the motorized SLFM 500 showing other interior components. The microcontroller 916 is mounted to inside bottom surface of the lower housing 900. A magazine attachment screw 912 and nut 914 are visible in this view (partially sectioned in the cutting plane of cross section).

The foregoing and additional components of the motorized SLFM 500 are described in Table 2 below, wherein reference numerals correspond to those shown in FIGS. 18-35.

TABLE 2

| INDEX | DESCRIPTION |
|---|---|
| 500 | motorized speed loader for firearms magazine (SLFM) (assembly) |
| 510 | upper housing assembly |
| 520 | magazine housing assembly |
| 530 | lower housing assembly |
| 540 | magazine |
| 545 | previously loaded cartridge currently in magazine |
| 550 | cartridge currently being loaded from loading chamber into magazine |
| 555 | cartridges positioned on cartridge loading ramp |
| 600 | upper housing |
| 602 | bullet storage reservoir |
| 604 | cartridge loading area |
| 606 | lens recess |
| 608 | power on/off switch cutout |
| 610 | round selector switch cutout |
| 612 | lens |
| 614 | power on/off switch |
| 616 | number-of-rounds selector switch |
| 618 | selector knob |
| 620 | led indicator |
| 622 | magazine insertion slot |
| 624 | cartridge keep-down door |
| 626 | cartridge loading ramp |
| 628 | loading ramp angle |
| 630 | lens graphics |
| 700 | magazine housing, right |
| 702 | magazine housing, left |
| 704 | cam rotation clearance area |
| 706 | motor |
| 708 | idler gear |
| 710 | link, idler gear |
| 712 | link-to-horizontal-plunger pivot pin |
| 714 | link-to-horizontal-plunger attachment retaining ring |
| 716 | horizontal (second) sliding plunger |
| 718 | plastic cartridge tip-centering/locating recess on end of horizontal plunger |
| 720 | cam shaft hole |
| 722 | structural gusset |
| 724 | attachment nut constraint rib |
| 726 | attachment screw hole |
| 728 | magazine housing assembly locating boss |
| 730 | idler gear retention screw |
| 732 | link-to-idler gear pivot |
| 734 | link-to-idler gear attachment retaining ring |
| 736 | loading chamber |
| 738 | loading hole |
| 740 | horizontal (second) sliding plunger translation slot |
| 742 | drive gear |
| 744 | cam bushing |
| 746 | link, idler arm |
| 748 | link-to-arm pivot |
| 750 | link-to-arm attachment retaining ring |
| 752 | arm (idler arm) |
| 754 | idler arm retention screw |
| 756 | motor attachment screw |
| 758 | optical sensor, receiver |
| 760 | optical sensor, transmitter (emitter) |
| 762 | spring-loaded plunger for centering of bullet/cartridge |
| 764 | cam (cam profile) |
| 766 | cam agitator bump |
| 768 | cam shaft |
| 770 | anti-rotation feature |
| 772 | ball beahng/cam roller |
| 774 | vertical (second) sliding plunger |
| 776 | plastic tip of vertical plunger to eliminate metal contact with round |
| 778 | cam roller pivot pin |
| 780 | return spring |
| 782 | bushing |
| 784 | magnet |
| 786 | washer |

TABLE 2-continued

| INDEX | DESCRIPTION |
|---|---|
| 788 | magazine body |
| 790 | magazine butt |
| 792 | follower |
| 794 | follower spring |
| 796 | follower pushup feature for first round only |
| 800 | limit switch |
| 802 | limit switch lever |
| 804 | limit switch wire leads |
| 806 | hall sensor |
| 808 | wire leads for optical receiver |
| 810 | wire leads for optical emitter |
| 812 | housing attachment screw |
| 814 | alignment pin holes to keep left and right housings precisely aligned one with respect to the other |
| 816 | lean-back angle |
| 818 | rear surface of magazine |
| 900 | lower housing |
| 902 | rubber foot/damper |
| 904 | housing attachment screw |
| 906 | housing attachment screw boss |
| 908 | housing attachment screw hole |
| 910 | power entry grommet |
| 912 | magazine housing assembly attachment screw |
| 914 | magazine housing assembly attachment nut |
| 915 | processor of microcontroller 916 |
| 916 | microcontroller (or controller), includes the processor 915 |
| 917 | memory coupled to processor 915 of microcontroller 916 |
| 918 | receiving locating boss for magazine housing assembly |

Figure 36:
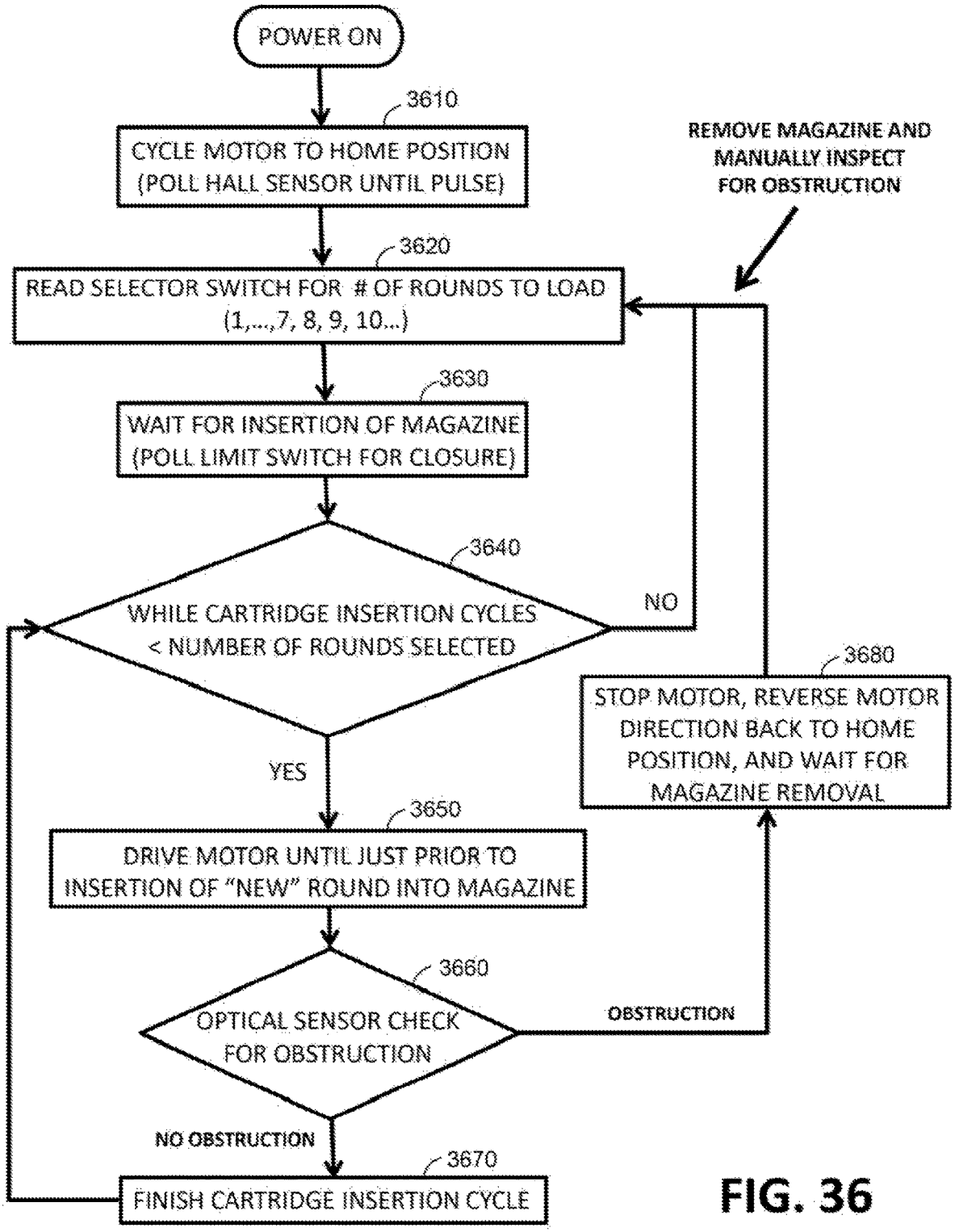
FIG. 36 is a flow chart illustrating a method for operating a motorized SLFM for execution by a processor thereof.

FIG. 36 illustrates an example of a method 3600 for operating a motorized SLFM, that may be held as encoded instructions in a memory 917 of the microcontroller 916 coupled to a processor 915 that when executed by the processor 915 (see FIG. 35), cause the apparatus 500 to perform the method 3600. After powering on with cartridges in the loading hopper, the method 3600 may include, at 3160, cycling the motor to a home position as described herein, for example by polling a hall sensor and counting stepper motor pulses, using an angular position sensor, or other sensor. The method 3600 may further include, at 3620, reading a current setting of the selector switch to determine a number of rounds to be loaded. The method 3600 may further include, at 3630, waiting for insertion of a magazine, for example by polling a limit switch as described herein. The method 3600 may further include, at 3640, cycling a predetermined number of cartridge insertion cycles, for example by executing a "do" loop a number of times equal to the number of rounds selected by the selection switch. The method 3600 may further include, at 3650 while the number of cycles is not exceeded, driving the motor until just prior to insertion of an incoming ("new") round into the magazine. The method 3600 may further include, at 3660, checking for an obstruction using an optical sensor, for example by processing a signal from one or more optical sensors as described herein. If the processor determines based on the optical sensor that an obstruction is present, the method 3600 may further include, at 3680 stopping the motor and then reversing the motor back to the home position to wait for removal of the magazine for the user to remove any obstruction and reset the speed loader. If the processor does not determine that an obstruction is present, The method 3600 may further include, at 3670, finishing the cartridge insertion cycle as described herein above.

Figure 37:
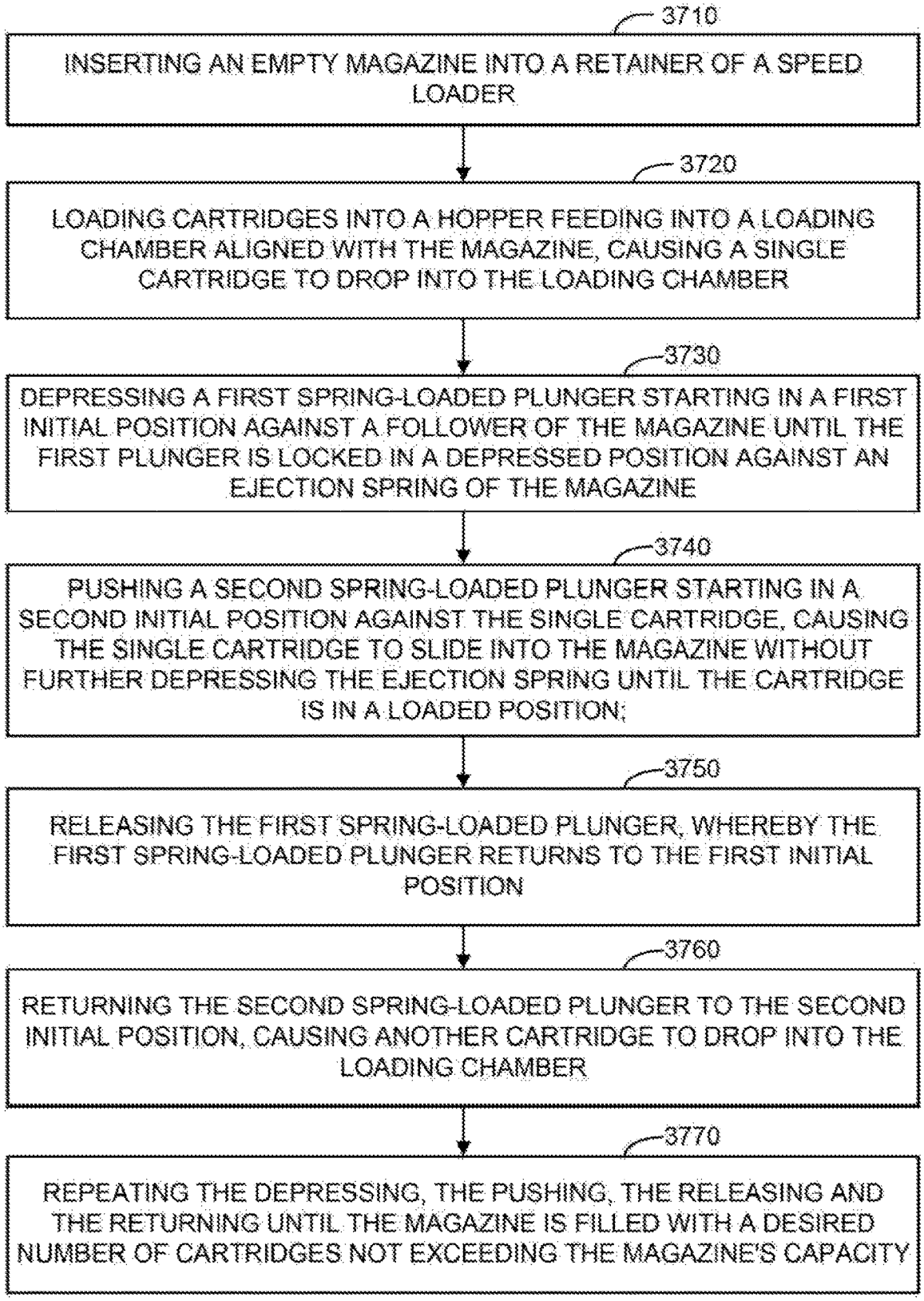
FIG. 37 is a flow chart illustrating a method for loading a firearms magazine using a SLFM as described herein.

FIG. 37 illustrates an example of method 3700 for loading a firearms magazine using a speed loader. At 3710, the method 3700 may include inserting an empty magazine into a retainer of the speed loader. At 3720, the method may include loading cartridges into a hopper feeding into a loading chamber aligned with the magazine, causing a single cartridge to drop into the loading chamber. At 3730, the method may include depressing a first spring-loaded plunger starting in a first initial position against a follower of the magazine until the first plunger is locked in a depressed position against an ejection spring of the magazine. At 3740, the method may include pushing a second plunger starting in a second initial position against the single cartridge, causing the single cartridge to slide into the magazine without further depressing the ejection spring until the cartridge is in a loaded position. At 3750, the method may include releasing the first spring-loaded plunger, whereby the first spring-loaded plunger returns to the first initial position. At 3760, the method may include returning the second plunger to the second initial position, causing another cartridge to drop into the loading chamber. At 3770, the method may include repeating the depressing, the pushing, the releasing and the returning until the magazine is filled with a desired number of cartridges not exceeding the magazine's capacity.

In another aspect of the method 3700, the depressing, the pushing, the releasing and the returning are driven by a motor as described herein above. Additional method operations, further details of the described operations, and variations of the described operations of the method 3700 will be apparent in view of the foregoing descriptions of the apparatus 10, 500 and their operations.

Illustrative examples of motorized and non-motorized embodiments having been described, the scope of the inventive subject matter is determined by the appended claims and their legal equivalences.

The invention claimed is:

1. An apparatus for loading cartridges into a firearms magazine, comprising:

a loader body comprising a retainer configured for holding a firearms magazine;

a first spring-loaded plunger coupled to the loader body, oriented for pushing one or more cartridges into the firearms magazine so as to depress a magazine spring thereof;

a second plunger coupled to the loader body, oriented for inserting cartridges into the firearms magazine without further depressing the magazine spring while the first spring-loaded plunger is depressing the magazine spring, wherein the second plunger is coupled to a return mechanism; and a reset mechanism that automatically resets the first spring-loaded plunger after the second plunger completes insertion of each cartridge into the magazine, wherein the reset mechanism comprises a locking component that holds the first spring-loaded plunger depressed against the magazine spring while the second plunger initiates insertion of one of the cartridges into the firearms magazine and automatically releases the first spring-loaded plunger after the one of the cartridges is partially inserted into the firearms magazine.

2. The apparatus of claim 1, further comprising a motor driving the first and second plungers via an idler gear, the idler gear driving the first spring-loaded plunger by a cam configured to rotate with the idler gear around a shaft, and the idler gear coupled to the second spring-loaded plunger by at least one link pivotably connected to the idler gear, wherein the cam and the at least one link are configured to operate with the idler gear such that the motion of the first and second plungers is synchronized.

3. The apparatus of claim 1, wherein the reset mechanism further comprises the cam, a cam roller following the cam, and a spring coupled to the first spring-loaded plunger.

4. The apparatus of claim 1, further comprising a spring-loaded movable safety wall interposed between the retainer and the second plunger.

5. The apparatus of claim 4, wherein the safety wall is coupled to the first spring-loaded plunger and includes an opening that admits a cartridge into the magazine only when the first spring-loaded plunger is depressed against the magazine spring.

6. The apparatus of claim 1, wherein the reset mechanism comprises a return spring and the locking component comprises interlocking snap ledges.

7. The apparatus of claim 1, further comprising a hopper that holds a plurality of cartridges and feeds each cartridge in turn to a loading chamber in front of the second plunger.

8. The apparatus of claim 7, wherein the hopper further comprises at least one of: a channel that retains cartridges in position during action of the first spring-loaded plunger and a profile that prevents misaligned cartridges from entering the loading chamber.

9. The apparatus of claim 1, further comprising a magazine clamp assembly clamping the firearms magazine in the retainer.

10. The apparatus of claim 2, further comprising a housing enclosing the loader body, first and second plungers, mechanism and motor.

11. The apparatus of claim 2, further comprising a cam coupled to the motor and configured for driving the first spring-loaded plunger.

12. The apparatus of claim 2, further comprising a control circuit including a processor coupled to the motor for controlling operation of the motor.

13. The apparatus of claim 12, further comprising a sensor coupled to the processor for sensing movement of at least the first spring-loaded plunger or a driving component connected thereto.

14. The apparatus of claim 13, wherein the processor is coupled to a memory holding program instructions that when executed by the processor determine whether at least the first spring-loaded plunger is jammed based on a signal from the sensor.

15. The apparatus of claim 13, wherein the sensor comprises at least one of an optical sensor, a hall effect sensor, and a current sensor.

16. The apparatus of claim 1, wherein the return mechanism comprises a return spring.

17. The apparatus of claim 2, wherein the return mechanism comprises a slider-crank driven by the motor, the slider-crank comprising the idler gear and the at least one link.

18. The apparatus of claim 2, further comprising a sensor fixed in relation to the idler gear for sensing a position thereof.

19. The apparatus of claim 18, wherein the sensor comprises a hall effect sensor for sensing a magnet attached to the idler gear.

20. The apparatus of claim 18, further comprising a control circuit including a processor coupled to the motor for controlling operation of the motor, wherein the processor is coupled to a memory holding program instructions that when executed by the processor determine a position of the idler gear based on a signal from the sensor.

21. A method for loading a firearms magazine using a speed loader, comprising:

inserting an empty magazine into a retainer of the speed loader;

loading cartridges into a hopper feeding into a loading chamber aligned with the magazine, causing a single cartridge to drop into the loading chamber;

depressing a first spring-loaded plunger starting in a first initial position against a follower of the magazine until the first plunger is locked in a depressed position against an ejection spring of the magazine;

pushing a second plunger starting in a second initial position against the single cartridge, causing the single cartridge to slide into the magazine without further depressing the ejection spring until the cartridge is in a loaded position;

releasing the first spring-loaded plunger, whereby the first spring-loaded plunger returns to the first initial position;

returning the second plunger to the second initial position, causing another cartridge to drop into the loading chamber; and repeating the depressing, the pushing, the releasing and the returning until the magazine is filled with a desired number of cartridges not exceeding the magazine's capacity, wherein a reset mechanism automatically resets the first spring-loaded plunger after the second plunger completes insertion of each cartridge into the magazine, the reset mechanism comprising a locking component that holds the first spring-loaded plunger depressed against the magazine spring while the second plunger initiates insertion of one of the cartridges into the firearms magazine and automatically releases the first spring-loaded plunger after the one of the cartridges is partially inserted into the firearms magazine.

* * * * *